US005836529A

United States Patent [19]

Gibbs

[11] Patent Number: 5,836,529

[45] Date of Patent: Nov. 17, 1998

[54] OBJECT BASED RAILROAD TRANSPORTATION NETWORK MANAGEMENT SYSTEM AND METHOD

[75] Inventor: Marshall A. Gibbs, Jacksonville, Fla.

[73] Assignee: CSX Technology, Inc., Jacksonville, Fla.

[21] Appl. No.: 550,881

[22] Filed: Oct. 31, 1995

[51] Int. Cl.[6] ..... B61L 23/22

[52] U.S. Cl. ..... 246/122 R; 246/167 R; 364/424.01; 364/424.04

[58] Field of Search ..... 246/3, 122 R, 246/123, 124, 132, 167 R, 169 R, 176; 364/424.01, 424.02, 424.04, 436

[56] References Cited

U.S. PATENT DOCUMENTS

| | | | |
|---|---|---|---|
| 5,390,880 | 2/1995 | Fukawa et al. | 246/167 R |
| 5,429,329 | 7/1995 | Wallace et al. | 246/166 |
| 5,445,347 | 8/1995 | Ng | 246/169 R |

OTHER PUBLICATIONS

Onsrud, Harlan J. and Reis, Robert I., "Law and Information Policy For Spatial Databases: A Research Agenda," Jurimetrics Journal, vol. 35, pp. 377–382 (Summer 1995).

Business Management Data, Inc., "Locomotive Management Systems III: Detail Design Document," pp. 1–14, 124–131, 521–560 (Aug. 9, 1994).

*Primary Examiner*—S. Joseph Morano

*Attorney, Agent, or Firm*—Carr & Ferrell LLP

[57] ABSTRACT

The system of the present invention preferably comprises a set of wayside occupancy detectors, an output device, a memory and a processing unit. Each wayside occupancy detector preferably generates a set of transport detection signals in response to detecting a set of mobile transports. The output device is used for displaying information. The memory, has a transport object comprising program instructions for automatically retrieving the set of transport detection signals and for automatically collecting a set of information related to operation of the transportation network. The memory also has a service object comprising program instructions for generating graphical representations of transport locations, transport status statistics, and transport performance statistics upon the output device corresponding to both the set of mobile transports and a set of fixed transports. The processing unit executes the program instructions stored in the memory and is coupled to the set of wayside occupancy detectors, the output device and the memory. The method of the present invention preferably comprises the steps of monitoring a set of real time identification, position, interconnection and display characteristics for the set of transports within the transportation network and generating an output display characterizing relationships between the set of transports based on the information collected in the monitoring step.

19 Claims, 15 Drawing Sheets

| Total Trains Delayed | Total Delay Time | Delay Description | % of Trains Delayed | % of Delay Time |
|---|---|---|---|---|
| 49 | 207'17" | No Power Available | 75.4 | 81.2 |
| 12 | 42'20" | No Crew Available | 18.5 | 16.5 |
| 3 | 06'40" | Train Not Ready | 4.6 | 2.7 |
| 1 | 00'30" | Connection Delay | 1.5 | 0.2 |

OBJECT BASED RAILROAD TRANSPORTATION NETWORK MANAGEMENT SYSTEM AND METHOD

BACKGROUND OF THE INVENTION

1. Field of the Invention

The present invention relates generally to transportation management systems. More particularly, the present invention relates to an object oriented system and method for real-time data management of a railroad transportation network.

2. Description of the Background Art

Many types of transportation networks are known to exist (i.e. railroad systems, highway systems, air freight systems and water-borne systems). Such transportation networks typically comprise massive cargo carrying devices. Locomotives and cars, comprising a train, are one example of such cargo carrying devices and make up the backbone of an operative, responsive and reliable railroad system. In addition to being very capital intensive, railroads are geographically distributed over thousands of miles. Goods and commodities must be moved from one station to the next in an efficient, reliable and timely manner, requiring the selection of sufficient resources to get a job done and satisfy the customer. Meeting the diverse needs of customers requires the coordinated efforts of a large number of management teams spread throughout a railroad system. Such teams are comprised of senior managers, line managers, train managers, locomotive managers, yard masters, dispatchers and customer service representatives who need specialized yet interrelated sets of railroad system information to perform such tasks as planning, sales, train and car blocking, scheduling, revenue collection, execution, customer management and reporting. Each of these teams requires information pertinent to their particular sphere of responsibility and quite commonly the information needs of these teams overlap.

Typically, each management team manually gathers the information they require piecemeal from a variety of sources. One team might routinely place telephone calls to each and every station to determine whether or not they have loads to ship that could be "blocked" with loads traveling by their train. "Blocking" is the assembling of optimal groups and sequences of cars based on their destination or a customer. Another team might also need to talk to the train master at every terminal so as to create a performance report detailing how well each terminal receives and processes trains throughout a particular time period. Yet another team might need to identify those train yards that have excess locomotive capacity and route their excess power to those yards needing additional power to move their cars. As a result of such direct and laborious point-to-point communication between those who need information and those who have it, each management team has typically had a only a very limited view of the entire railroad transportation network and has only achieved such a view at a great cost in human resources often resulting in the duplication of efforts.

As an example of the above labor intensive scenario, if a line manager needed to know how many coal trains require same day shipping, one set of clerks would be assigned that task. If the line manager also needed to know how many locomotives to assign to each coal train, a second set of clerks would be assigned that task. Furthermore, if the line manager needed to know which terminals had extra locomotives that could be coupled to coal trains requiring more power, yet a third set of clerks would be assigned that task. As a result, the three different sets of clerks might often be consulting the exact same files and talking to the exact same yard managers resulting in a wasteful duplication of efforts. Additionally, once all of the reports are generated, the line manager would most likely be so inundated with stacks of reports as to have serious difficulty sorting through them all in an organized manner. Furthermore, the reports generated for the line manager might be useful to a second line manager who might not normally communicate with the line manger and would thus have his own staff generate the exact same set of reports, resulting in another wasteful duplication of efforts. Lastly, employing large numbers of clerical personnel to gather data and compile unique reports for each management layer increases the odds of introducing errors each time information is passed between various management levels.

A system and method is needed to address the costly and inefficient data gathering and presentation problems mentioned above, since an efficiently run railroad system relies upon literally hundreds of sets of data that must be analyzed and organized in a meaningful way. What is needed is a system and method for automatically monitoring all resources within a transportation network, characterizing resource status, and determining resource performance characteristics according to flexible criteria. The required system and method would not only provide varying levels of detail dependent upon the needs of the particular user, but would also automatically generate alerts, warnings and/or alarms should a monitored resource deviate from its expected status or performance. Such computer implemented alerts, warnings and alarms are critical to the railroad transportation networks operation due to the high costs associated with late trains, unavailable locomotives and empty cars, just to name a few.

SUMMARY OF THE INVENTION

The present invention is an object based railroad transportation network management system and method, wherein the transportation network is comprised of a set of mobile transports and a set of fixed transports. The present invention automatically maintains a transportation network database; automatically generates transportation network status statistics, performance statistics, and warning signals for user-selectable transports within a user-selectable geographic region; and outputs graphical representations of the generated statistics and the warning signals. The system and method also enables users to select between either a broad or a detailed representation of the transportation network's operation.

The system of the present invention preferably comprises a set of wayside occupancy detectors, an output device, a memory and a processing unit. Each wayside occupancy detector preferably identifies the presence of a mobile transport and in response transmits a mobile transport detection signal to the processing unit. The memory, comprises a transport object comprising program instructions for automatically retrieving the set of transport detection signals and for automatically collecting a set of information related to operation of the transportation network. The memory further comprises a service object comprising program instructions for generating graphical representations of transport locations (based on the set of transport detection signals), transport status statistics, and transport performance statistics upon the output device corresponding to both the set of mobile transports and a set of fixed transports. The processing unit executes the program instructions stored in the memory and is coupled to the set of wayside occupancy detectors, the output device and the memory. The output device is used for displaying information.

The method of the present invention preferably comprises the steps of prompting the user to select a set of transportation network boundaries, determining a transportation network layout within the selected boundaries, determining a fixed transport's and a mobile transport's identification, position, and display characteristics within the selected boundaries, prompting the user to select the fixed and mobile transport's status and performance criteria and retrieving either a system-defined or user-defined set of status and performance warning criteria. The preferred method continues by selecting a transport, retrieving the transport's real-time status and performance data, comparing the data retrieved with the selected status and performance criteria specified earlier and adding the selected transport's identification (ID) to an output list if the real time criteria falls within the bounds of the selected criteria. Next, the method proceeds to determine whether the data retrieved conforms with the warning criteria specified earlier and activating an alert signal, on the output device if the retrieved data falls within the bounds of the warning criteria. The method then proceeds to generating a first output display limited by the selected boundaries and depicting relationships between those transports included in the output list, described above and generating a second output display representing the retrieved real-time status and performance data for those transports included in the output list.

DETAILED DESCRIPTION OF THE PREFERRED EMBODIMENT

The present invention is an object based railroad transportation network management system and method. The system and method automatically maintains a highly structured railroad system information database and generates multiply nested maps, tables, charts and alerts for providing varying levels of real-time perspective on an operating railroad system. These levels of perspective range from a "system-wide" view needed by executives, senior managers and planners to an individualized and detailed report needed by a customer service representative, a train master or a dispatcher. In addition, the system automatically generates alert signals according to customizable warning criteria whenever a variance from planned operation has occurred. The present invention generates an easy-to-use, consistent user interface that provides graphical characterizations of transportation network status conditions and performance criteria at multiple levels of detail. The present invention directly provides railroad personnel with a powerful set of tools for maximizing resource utilization, minimizing exceptions and improving on-time delivery to their customers. The present invention is particularly advantageous over the prior art because of its ability to automatically generate graphical status and performance indicators from both historical and real-time data, thereby aiding users ranging from executives to clerks in the areas of planning, sales, optimum blocking, scheduling, revenue collection, shipment, customer management and report generation. The present invention's preferred embodiment in an object oriented programming environment is also highly advantageous because the real world resources within the transportation network (i.e. trains, terminals, crews, locomotives, etc.) lend themselves to an object-oriented programming paradigm. For instance, a real world train is defined by a large number of data items (i.e. its position, its cargo, its estimated time of arrival, etc.) that change as the train progresses along its route. Thus, a train object, which references and automatically updates such train related data items, advantageously provides a single source for other objects within the transportation network to obtain information about the train's status and performance.

Figure 1:
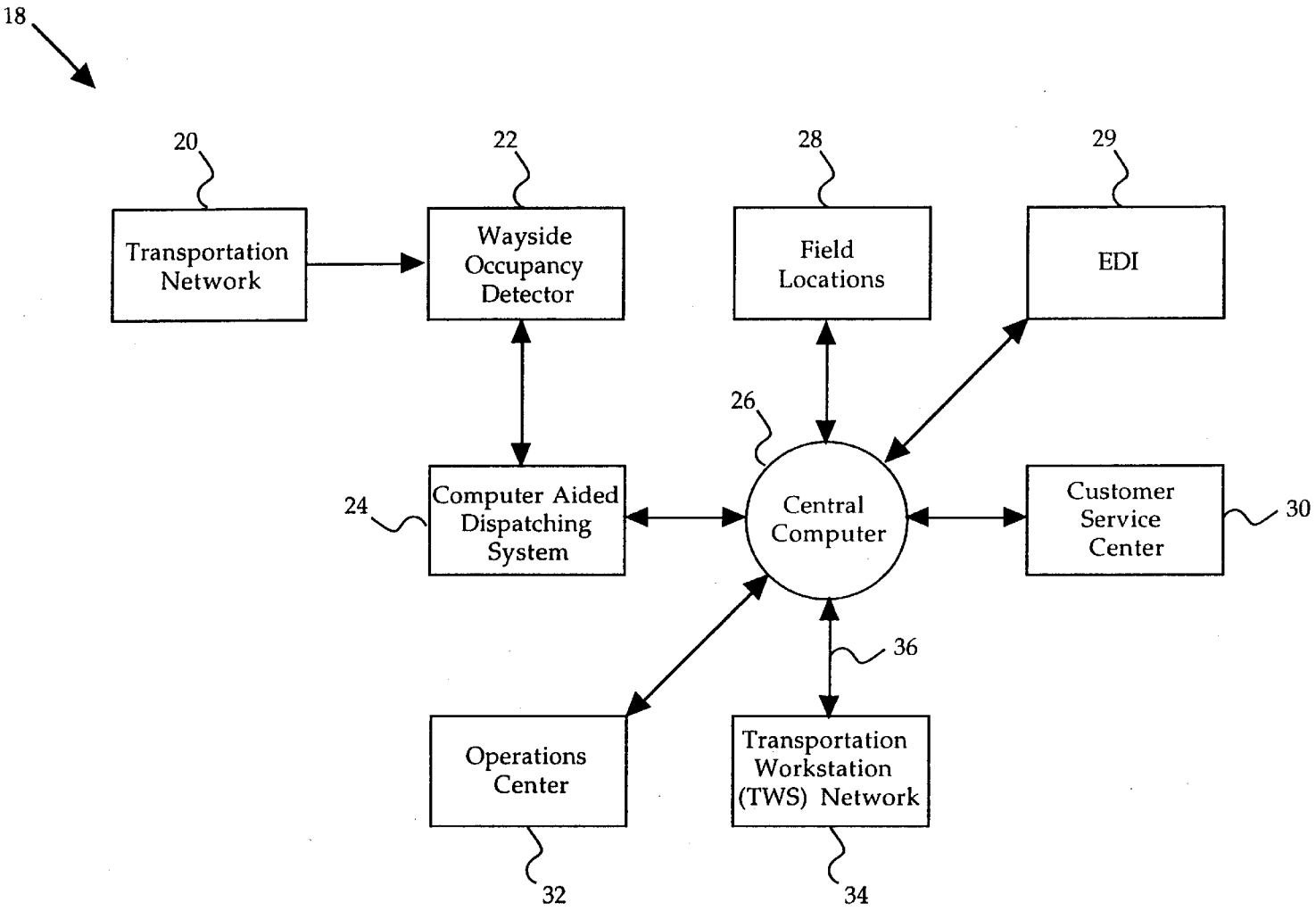
FIG. 1 is a block diagram of a preferred embodiment of an object based railroad transportation network management system.

Referring now to FIG. 1, a block diagram of a preferred embodiment of an object based railroad transportation network management system 18 is shown. The system 18 comprises a transportation network 20, a wayside occupancy detector 22, a computer-aided dispatching system 24, a central computer 26, at least one field location 28, an EDI 29, a customer-service center 30, an operations center 32 and a transportation workstation (TWS) network 34. The transportation network 20 is well known in the art and preferably is a railroad system consisting of a layout (i.e. a set of train tracks) and a set of transports. The set of transports further comprises a set of fixed transports (for example: terminals, yards and shops) and a set of mobile transports (for example: trains, locomotives, crews, cars, end of train devices). Those skilled in the art will recognize that the transportation network 20 could alternatively be a highway system, an airline system, a ship system or any other type of geographically referenced cargo carrying system. The wayside occupancy detector 22 is also well known in the art and detects when a train has passed a particular geographic latitude and longitude on the transportation network 20. A very large number of wayside occupancy detectors 22, perhaps on the order of ten-thousand or more, are distributed throughout the transportation network 20. The wayside occupancy detector 22 is coupled to the computer aided dispatching system 24 and transmits a train detection signal to the computer aided dispatching system 24. Each time a train passes the wayside occupancy detector 22, the train detection signal is sent to the computer aided dispatching system 24; otherwise, no train detection signal is sent. When the computer aided dispatching system 24, also well known in the art, receives the train detection signal, the computer aided dispatching system 24 stores the train detection signal in a register, determines a last train in an area around the wayside occupancy detector 22 and associates the train detection signal with the last train in the area. The computer aided dispatching system 24 then generates a train location signal containing the latitude/longitude of the wayside occupancy detector 22 which thus pinpoints the location of last train in the area. The computer aided dispatching system 24 then transfers this latitude/longitude information to the central computer 26. The central computer 26 forms a nexus of a local area network preferably configured in a conventionally known star network. Those skilled in the art will realize that other local area network configuration are possible. The central computer 26 acts as a hub, to which the computer-aided dispatching system 24, the set of field locations 28, the EDI 29, the customer-service center 30, the operations center 32 and the TWS network 34 are preferably coupled to form nodes. The central computer 26 receives: a train location signal from the computer-aided dispatching system 24; incident reports, local jobs and yard jobs from the field location 28; standard messages between systems from the EDI 29; work orders and alerts from the customer-service center 30; equipment inventories, slow orders, curfews, power assignments, power plan, train plan and physical plant data from the operations center 32; and information requests from the TWS network 34. The central computer 26 organizes and stores this railroad system information so that it can later retransmit the information in response to a request from any of the nodes 24, 28, 29, 30, 32, 34. The set of field locations 28, the EDI 29, the customer-service center 30 and the operations center 32 are all conventionally known in the art.

Figure 2:
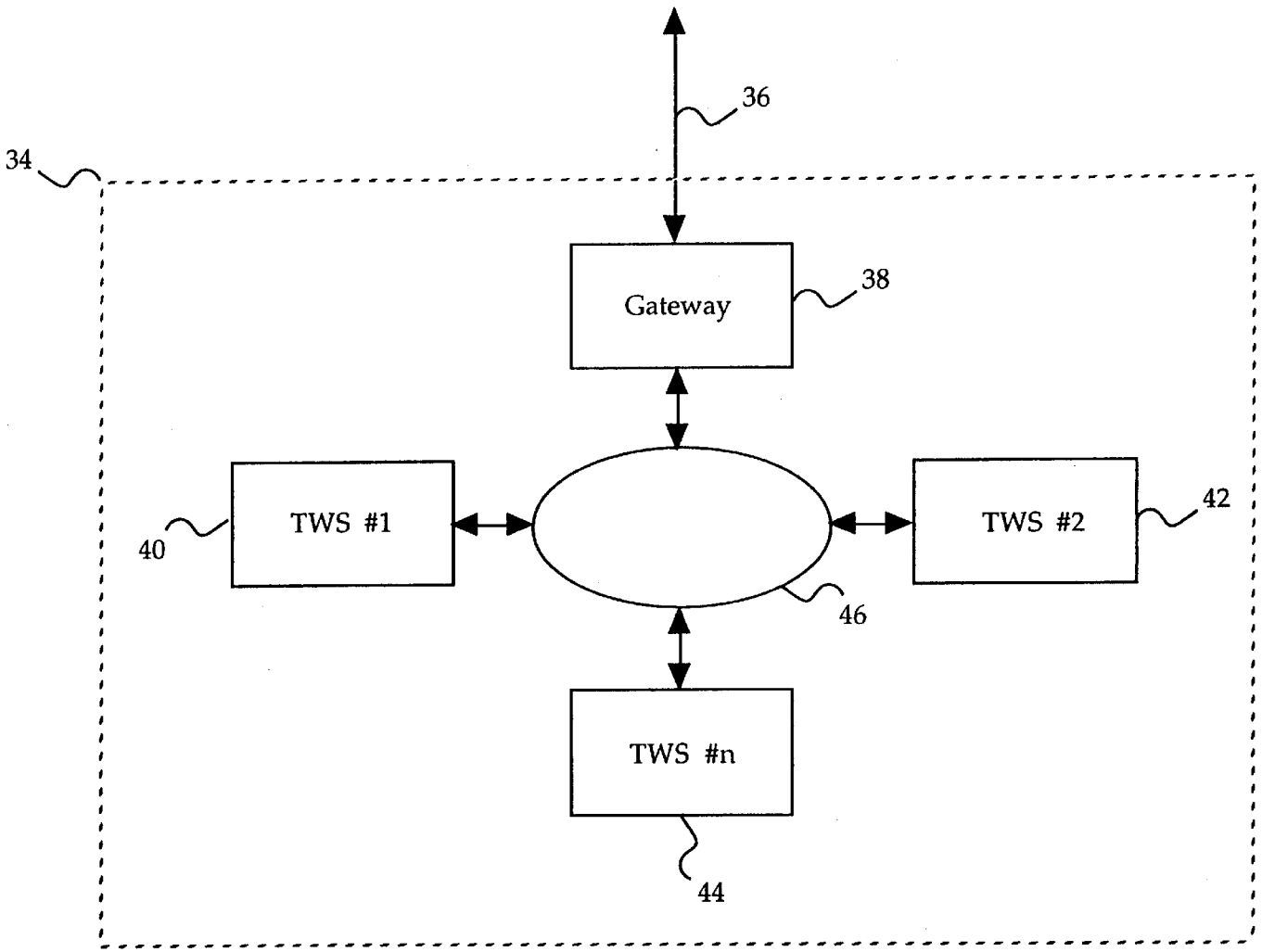
FIG. 2 is a block diagram of a preferred embodiment of a Transportation Workstation (TWS) Network of the present invention.

Referring now to FIG. 2, a block diagram of a preferred embodiment of the TWS network 34 of the present invention is shown. The TWS network 34 comprises a gateway 38 and a set of TWSs 40, 42, 44 preferably coupled together on a token ring network 46. Those skilled in the art, however, will realize that other network configurations could be used. The gateway 38 is coupled to the central computer 26 via a first interface 36. Shown in FIG. 2 are three nodes, TWS#1 40, TWS#2 42 and TWS#n 44; however, those skilled in the art will recognize that additional or fewer TWSs may be coupled to the token ring network 46. The gateway 38 is conventionally known and provides an interface between the central computer 26 and the token ring network 46. Preferably, each TWS 40, 42, 44 is identical in capability and functionality, as will be discussed in detail below in reference to FIG. 3. The token ring network 46 is of a type conventionally known in the art.

Figure 3:
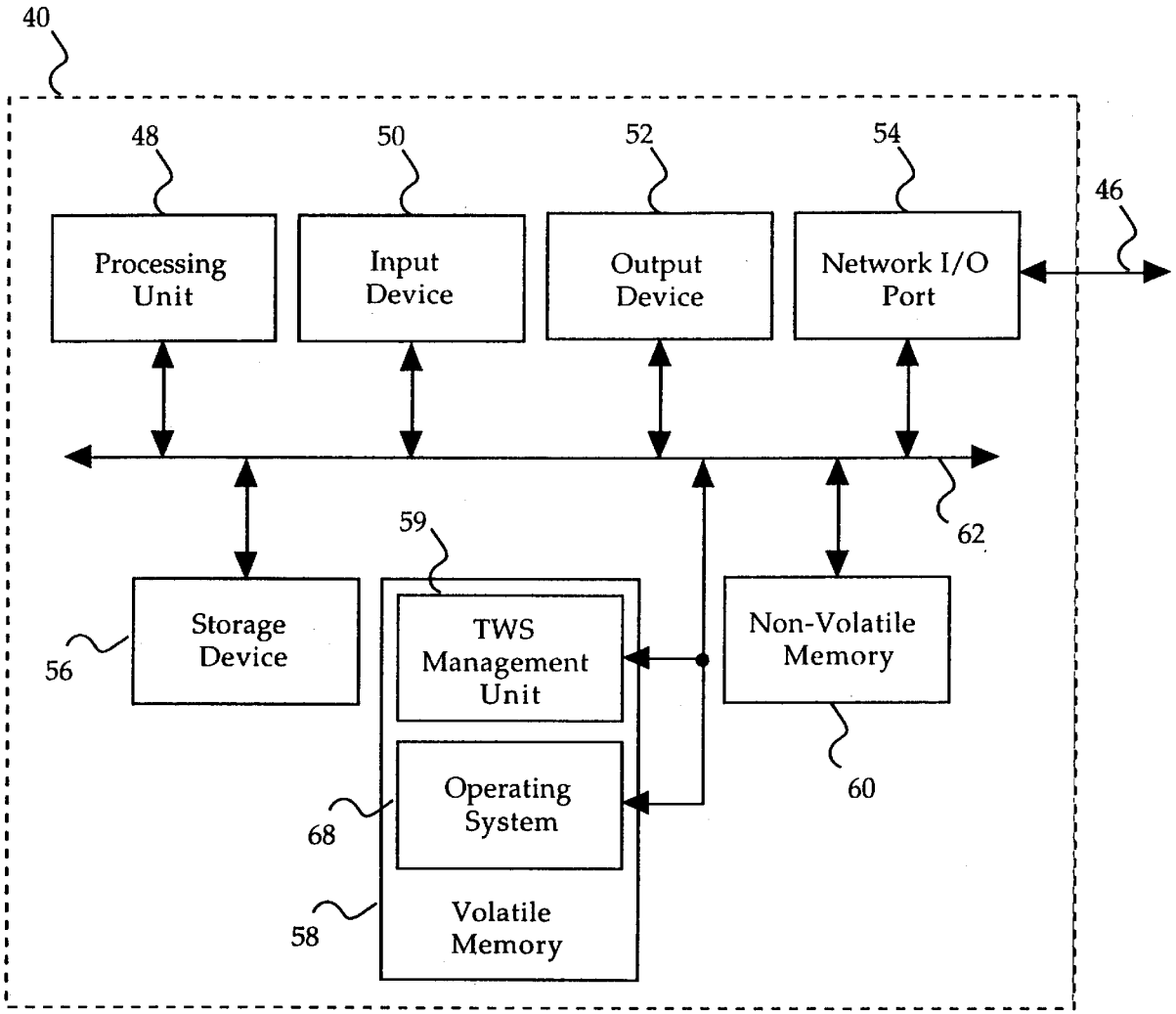
FIG. 3 is a block diagram of a preferred embodiment of a TWS within the TWS Network.

Referring now to FIG. 3, a block diagram of a preferred embodiment of a representative TWS 40 within the TWS network 34 is shown. The TWS 40 comprises a processing unit 48, an input device 50, an output device 52, a network I/O port 54, a storage device 56, a volatile memory 58, a TWS management unit 59, an operating system 68 and a non-volatile memory 60, all coupled via a bus 62. Elements 48, 50, 52, 54 and 60 of the TWS 40 are conventionally known in the art. The storage device 56 and the volatile memory 58, however, due to their stored program instructions discussed below, are not conventionally known in the art. In the preferred embodiment, the TWS 40 is a stand-alone personal computer. The processing unit 48 executes programming instructions stored in the storage device 56, the volatile memory 58 and the non-volatile memory 48, as discussed below. The input device 50 is preferably a conventional keyboard and mouse for receiving commands from a user and translating the commands into signals which are sent to the processing unit 48. The output device 52 is preferably a conventional display monitor for receiving and selectively displaying information to the user in response to commands from the processing unit 48. The output device 52 may also include an audible alert warning capability. The network I/O port 54 couples the TWS 40 to the token ring network 46 and handles message passing functions for the TWS 40. It is via the network I/O port 54 that the TWS 40 receives railroad system information from the central computer 26.

The storage device 56 is a computer useable medium, preferably a hard disk drive, storing a set of computer readable program instructions for controlling how the processing unit 48 accesses, transforms and outputs data, as described in detail below with reference to FIG. 4. Those skilled in the art will recognize that in alternate embodiments the storage device 56 could be replaced with a functionally equivalent computer useable medium such as: a compact disk and drive; a floppy disk and drive; and/or a memory card. The volatile memory 58 contains memory locations suitable for storing program instructions from either the storage device 56 or the non-volatile memory 60 until execution by the processing unit 48 and for storing the intermediate results generated by the processing unit 38. The volatile memory 58 is preferably a Random Access Memory (RAM) device and includes the TWS management unit 59 and the operating system 68.

The TWS management unit 59 preferably comprises a set of executable program instructions for launching and operating the TWS 40. A detailed discussion of the TWS management unit's 59 operation is provided below. The operating system 68 preferably includes a multitasking capability, a graphical user interface and a local area network interface. OS/2, an operating system sold by International Business Machines Inc. (IBM), fits the above preferences and is preferably employed in the present invention. Those skilled in the art will recognize however, that other operating systems can also be employed within the TWS 40. The non-volatile memory 60 also may contain a set of program instructions that control the operation of the processing unit 48 and is preferably a Read Only Memory (ROM) device.

Figure 4:
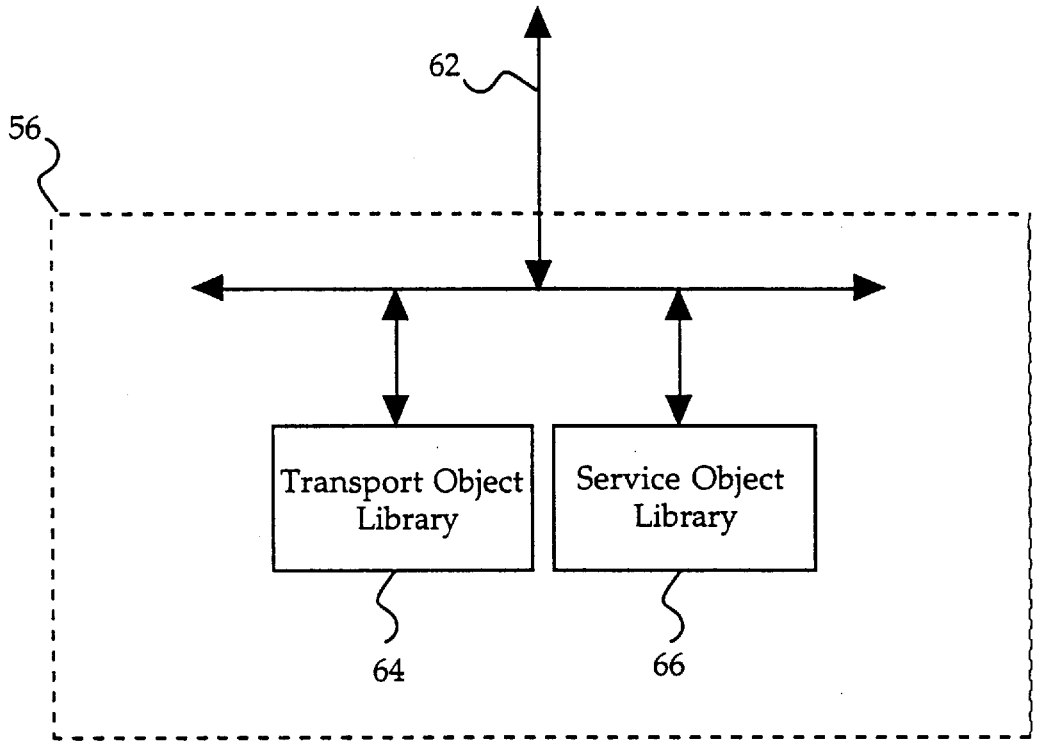
FIG. 4 is a block diagram of a preferred embodiment of a storage device within the TWS.

Referring now to FIG. 4, a block diagram of a preferred embodiment of the storage device 56 within the TWS 40 is shown. The storage device 56 comprises a transport object library 64 and a service object library 66, each coupled to the bus 62. The transport object library 64 preferably comprises a set of transport objects preferably stored in a dynamic-link library (DLL) configuration well known in the art and representing various tangible assets within the transportation network 20. Additional details regarding each of the transport objects within the transport object library 64 is provided below in reference to FIG. 5. The service object library 66 preferably comprises a set of service objects which are also preferably stored in a DLL configuration and represent various user interface, map generation and report generation capabilities within the TWS 40 that pertain to the operation of the transportation network 20. Additional details discussing each of the service objects within the service object library 66 is presented below in reference to FIGS. 6*a*, 6*b*, 6*c*. Alternate embodiments of the present invention store the transport object library 64 and the service object library 66 in the volatile memory 58 and avoid the dynamic-link library configuration.

Figure 5:
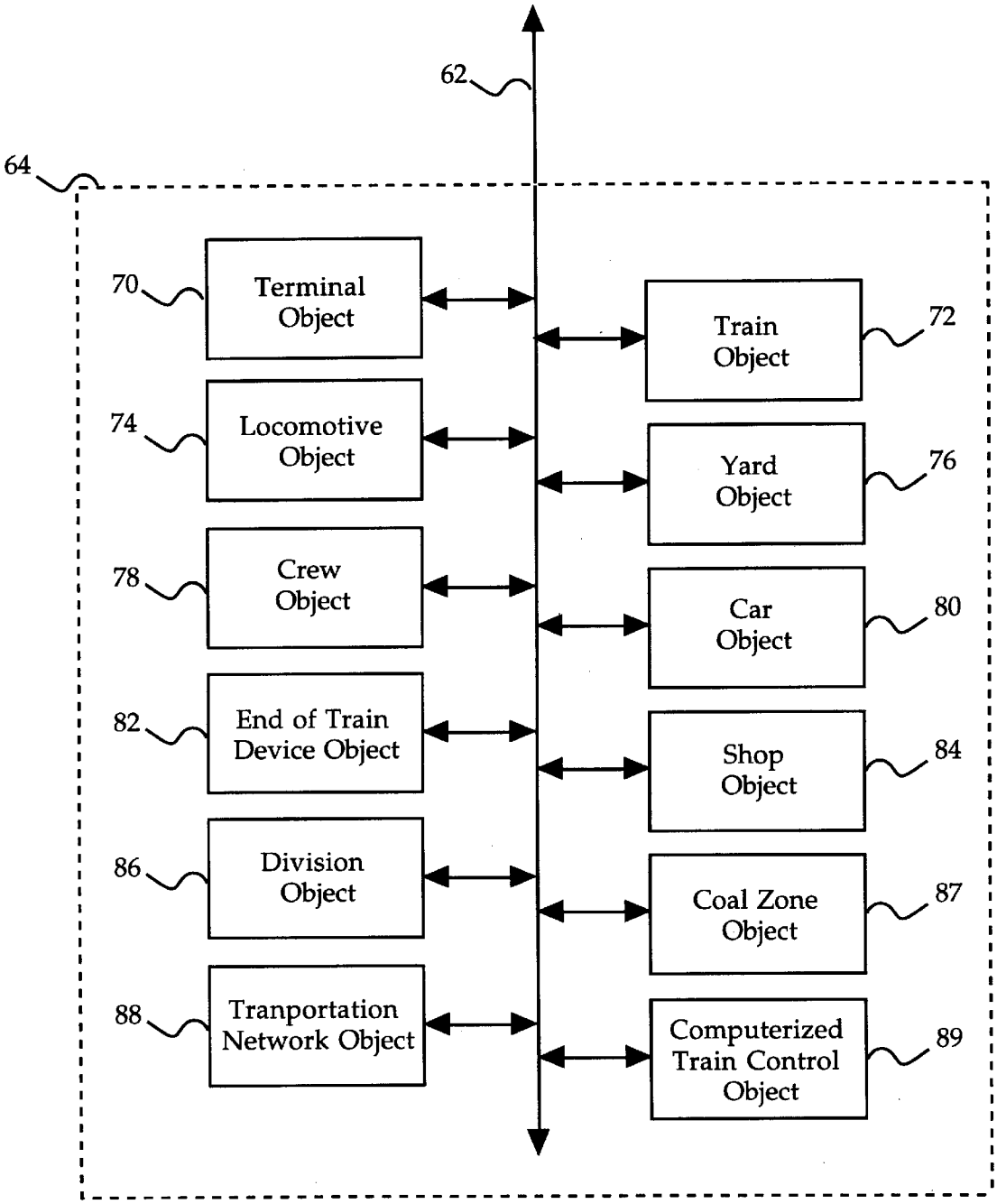
FIG. 5 is a block diagram of a preferred embodiment of a transport object library within the storage device.

Referring now to FIG. 5, a block diagram of a preferred embodiment of the transport object library 64 within the storage device 56 is shown. The transport object library 64 is preferably comprised of a set of mobile transport objects representing geographically dynamic transports and a set of fixed transport objects representing geographically static transports. The mobile transport objects include a train object 72, a locomotive object 74, a crew object 78, a car object 80, an end-of-train device object 82 and a computerized train control object 89. The computerized train control object 89 is listed under the mobile transport object category since it is comprised of a set of railroad track switches whose position moves under a dispatcher's command. The fixed transport objects include a terminal object 70, a yard object 76, a shop object 84, a division object 86, a coal zone object 87, and a transportation network object 88. The transportation network object 88 is listed under the fixed transport object category since it is comprised of a set of fixed railroad track segments whose position remains constant. Those skilled in the art will recognize other transport objects that can be created to represent various other tangible components of the transportation network 20. Each of the transport objects (70 through 89) preferably comprise a set of references to a transport object data structure 98, described in detail in FIG. 7 below, and program instructions. The transport objects (70 through 89) are treated by the processing unit 48 as discrete entities within an object-oriented programming structure as conventionally known in the art. The program instructions within each of the transport objects (70 through 89) respectively comprise routines for obtaining data items from the central computer 26 preferably every 30 minutes or upon a specific user request and storing the data items within the transport object data structure 98. The transport object's (70 through 89) program instructions effect this data retrieval by sending an information request through the network I/O port 54 and the gateway 38 to the central computer 26 and receiving the requested information via the same path.

The data item obtained and stored by each of the transport objects (70 through 89) are now introduced. The terminal object 70 maintains data items for a set of terminals on the transportation network 20, each preferably comprising a grouping of rail stations and railpoints for a specified geographic area. The train object 72 maintains data items for a set of trains located between various geographic on-signal points and pulling various types of goods and commodities. The locomotive object 74 maintains data items for a set of locomotives located between various geographic on-signal points that pull varying numbers of cars. The yard object 76 maintains data items for a set of yards comprising a system of tracks branching from a common lead or ladder track, with defined limits, used for switching, making-up trains or storing cars. The crew object 78 maintains data items for a set of crews distributed throughout the transportation network 20 and comprising a set of workers who effect the movement of trains. The car object 80 maintains data items for a set of cars each optimized for carrying a particular type of load and pulled by a locomotive. The end-of-train device object 82 maintains data items for a set of end of train devices coupled to a last car on a train and providing a coupling mechanism for completing the train's air brake circuit as well known in the art. The shop object 84 maintains data items for a set of shops locate throughout the transportation network 20 for performing maintenance on various components of the transportation network 20. The division object 86 maintains data items for a set of geographic regions throughout the transportation network 20 and includes a set of yards, stations and sidings all under the management of a superintendent. The coal zone object 87 maintains data items for a set of recurrent train circuits throughout the transportation network 20. A recurrent train circuit is a regularly scheduled route within the transportation network 20, for example, loading coal at a coal mine and transporting the coal to a power plant on a weekly schedule. The transportation network object 88 maintains data items for an idealized geographic display of the transportation network 20, including a layout for a set of sets of train tracks and geographic positions of yards, terminal, trains and any other component of the transportation network 20. The computerized train control object 89 maintains data items for a detailed train track layout for a selected terminal and track segment. The specific data items updated by the various transport objects (70 through 89) is discussed below in reference to FIG. 7.

Figure 6A:
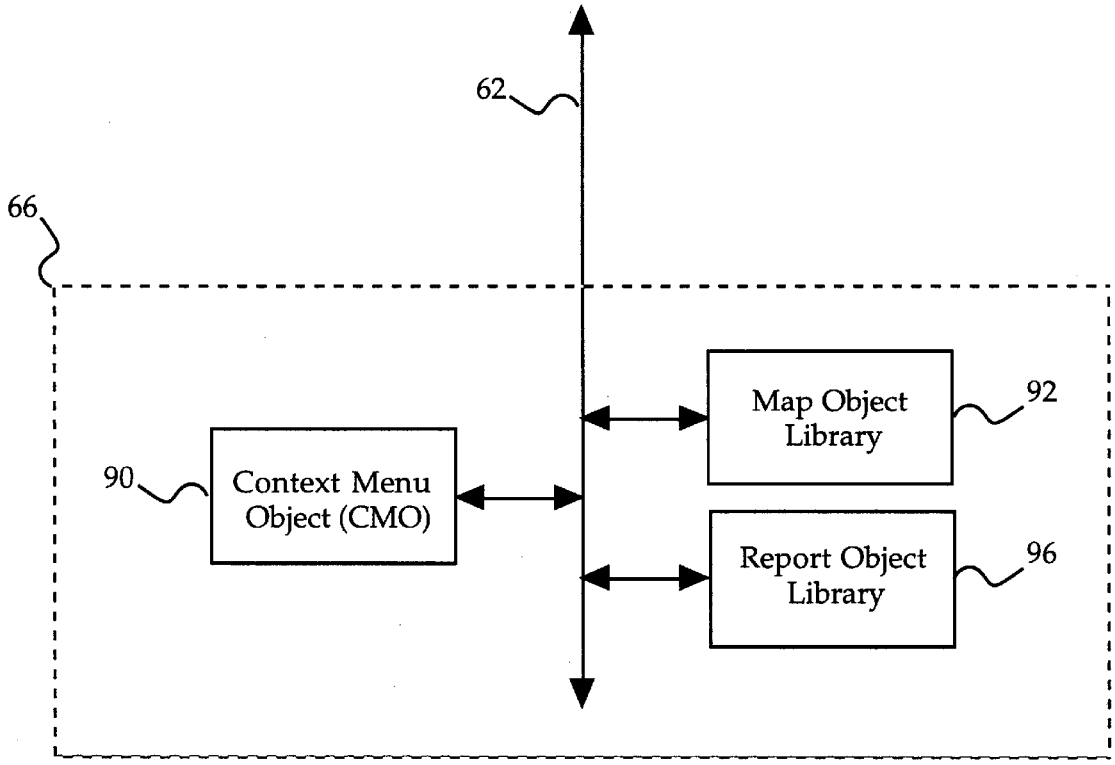
FIG. 6*a* is a block diagram of a preferred embodiment of a service object library within the storage device.

Referring now to FIG. 6*a*, a block diagram of a preferred embodiment of the service object library 66 within the storage device 56 is shown. The service object library 66 comprises a context menu object (CMO) 90, a map object library 92 and a report object library 96. The CMO 90 is comprised of both programming instructions and data items and is treated by the processing unit 48 as a discrete entity within the object-oriented programming structure. The CMO 90 is a primary interface for receiving the user's commands from the input device 50. The CMO 90 preferably generates multiple lists of user selectable menu items and activates and monitors a set of preferably point-and-click icons on the output device 52, thus enabling the user to directly activate each of the objects within the map object library 92 and the report object library 96. Details of the CMO's 90 actual operation is discussed below.

The map object library 92 contains a set of map objects (400 through 412) which generate or modify various maps, containing transportation network 20 information, on the output device 52. Details of each of the map object's (400 through 412) operation is discussed below. The report object library 96 contains a set of report objects (414 through 420) which generate or modify various reports, containing transportation network 20 information, on the output device 52. Details of each of the report object's (414 through 420) operation is discussed below.

Figure 6B:
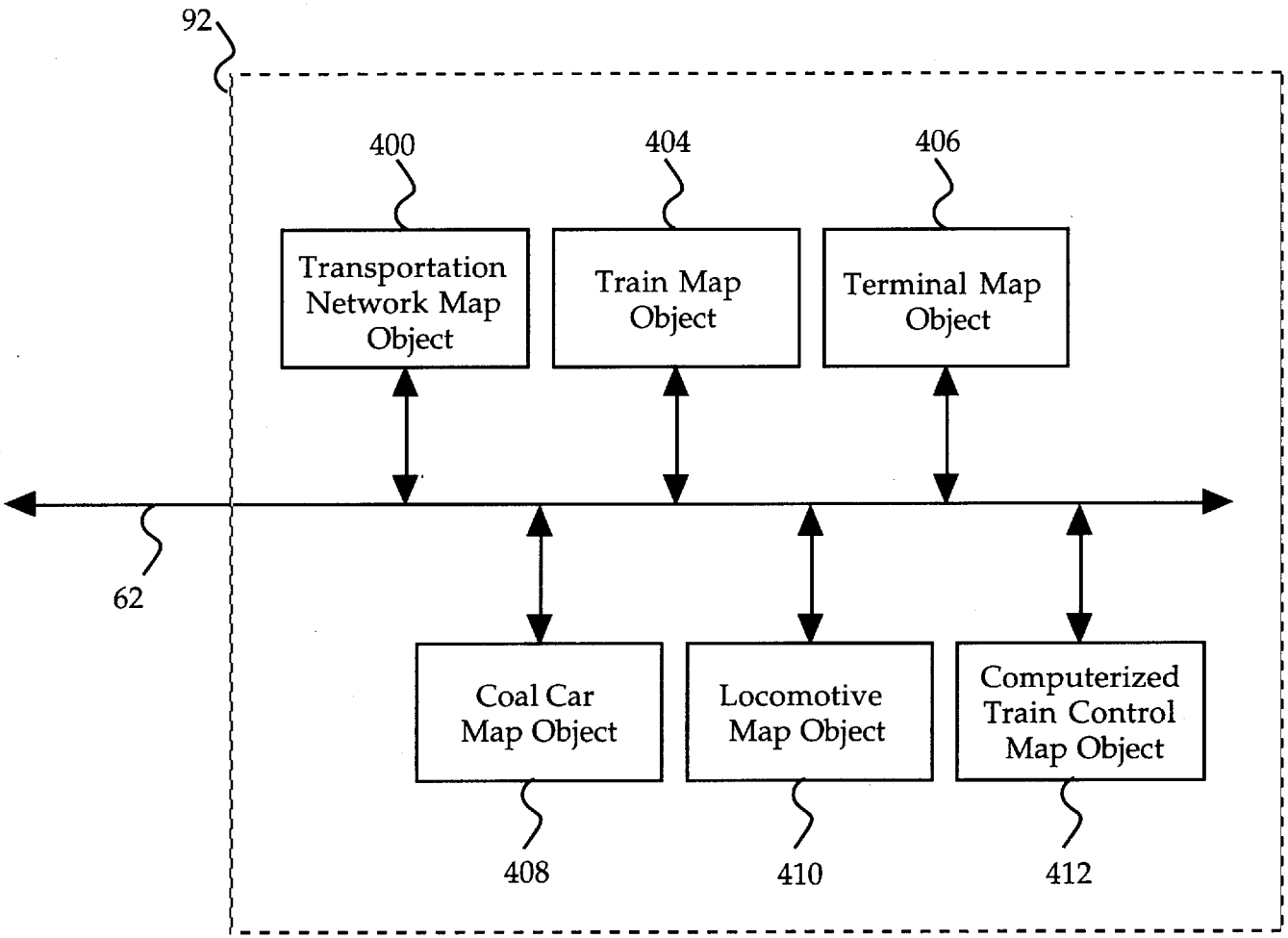
FIG. 6*b* is a block diagram of a preferred embodiment of a map object library within the service object library.

Referring now to FIG. 6*b*, a block diagram of a preferred embodiment of the map object library 92 within the service object library 66 is shown. The map object library 92 comprises a transportation network map object 400, a train map object 404, a terminal map object 406, a coal car map object 408, a locomotive map object 410 and a computerized train control map object 412. Each of the map objects (400 through 412) are preferably objects, comprising both program instructions and data items, that are treated by the processing unit 48 as discrete entities within an object-oriented programming structure as conventionally known in the art. The program instructions within each of the map objects (400 through 412) preferably comprise routines for obtaining and retaining data items from the transport objects (70 through 89) and then respectively generating or modifying an appropriate map in response to a user request received from the CMO 90. The map object's (400 through 412) program instructions effect this map generation or modification by sending an information request to an appropriate set of transport objects and after receiving the requested information, generating or modifying the user requested map. All of the preferred map objects (400 through 412) are now introduced, however those skilled in the art will recognize other map objects that can be created to depict various other views of the transportation network 20. The transportation network map object 400 preferably comprises program instructions and data items for creating maps of variable size displaying a set of corner railpoints, intersection railpoints, station railpoints and interconnections between each of the aforementioned railpoints. The train map object 404 preferably comprises program instructions and data items for selectively generating maps to display various train related information. The terminal map object 406 preferably comprises program instructions and data items for selectively generating maps to display various terminal related information. The coal car map object 408 preferably comprises program instructions and data items for selectively generating maps to display various coal train related information. The locomotive map object 410 preferably comprises program instructions and data items for selectively generating maps to display various locomotive related information. The computerized train control map object 412 preferably comprises program instructions and data items for generating maps displaying selected segments of the train tracks from a dispatcher's point of view. The maps created by the various map objects (400 through 412) are discussed in detail below.

Figure 6C:
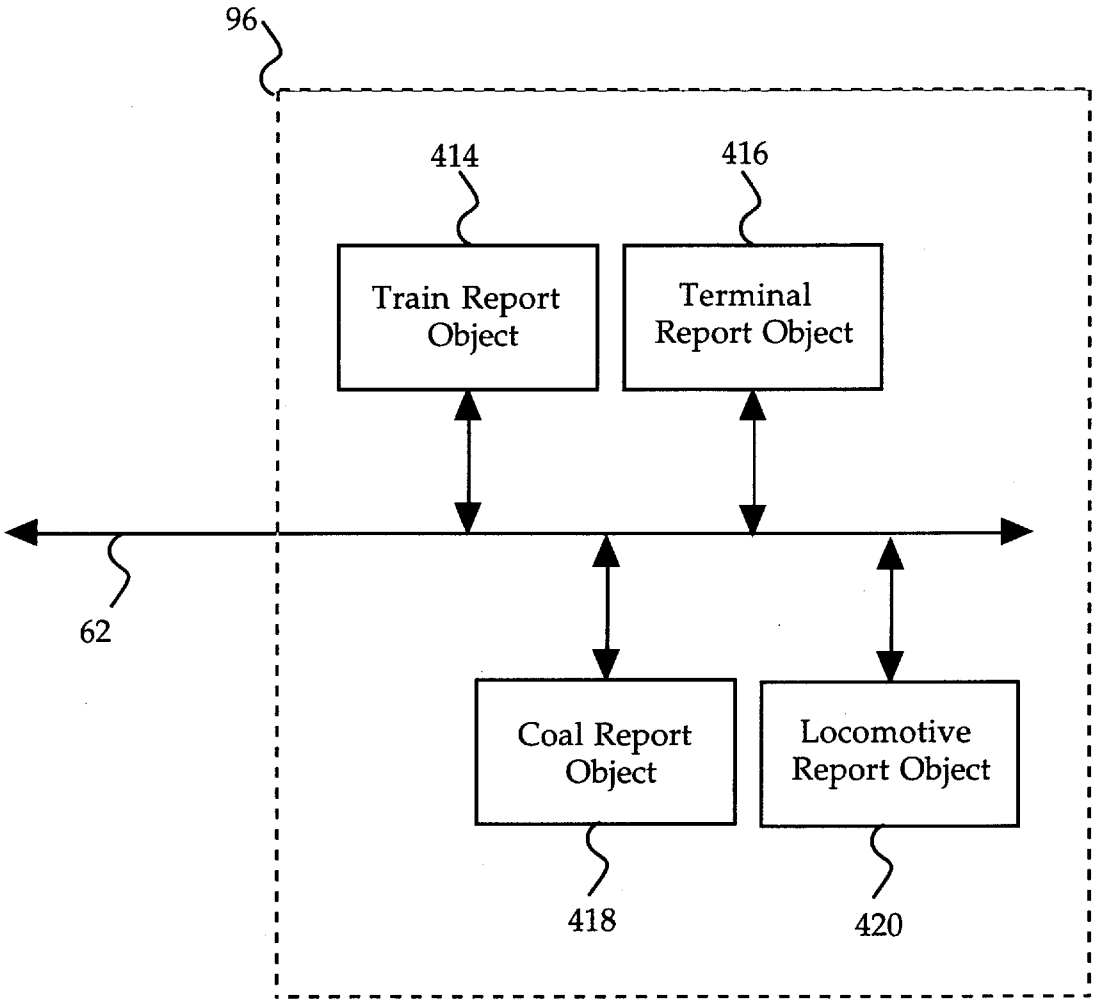
FIG. 6*c* is a block diagram of a preferred embodiment of a report object library within the service object library.

Referring now to FIG. 6*c*, a block diagram of a preferred embodiment of the report object library 96 within the service object library 66 is shown. The report object library 96 comprises a train report object 414, a terminal report object 416, a coal report object 418, and a locomotive report object 420. Each of the report objects (414 through 420) are preferably objects, comprising both program instructions and data items, that are treated by the processing unit 48 as discrete entities within an object-oriented programming structure as conventionally known in the art. The program instructions within each of the report objects (414 through 420) preferably comprise routines for obtaining and retaining data items from the transport objects (70 through 89) and then respectively generating an appropriate report in response to a user request received from the CMO 90. The report object's (414 through 420) program instructions effect this report generation by sending an information request to an appropriate set of transport objects and after receiving the requested information, generating the user requested report. The preferred set of report objects (414 through 420) are now introduced, however those skilled in the art will recognize other report objects that can be created to generate various characterizations of the transportation network 20. The train report object 414 preferably comprises program instructions and data items for creating reports containing various train related information. The terminal report object 416 preferably comprises program instructions and data items for creating reports containing various terminal related information. The coal report object 418 preferably comprises program instructions and data items for creating reports containing various coal train related information. The locomotive report object 420 preferably comprises program instructions and data items for creating reports containing various locomotive related information. The reports created by the various report objects (414 through 420) are discussed in detail below.

Figure 7:
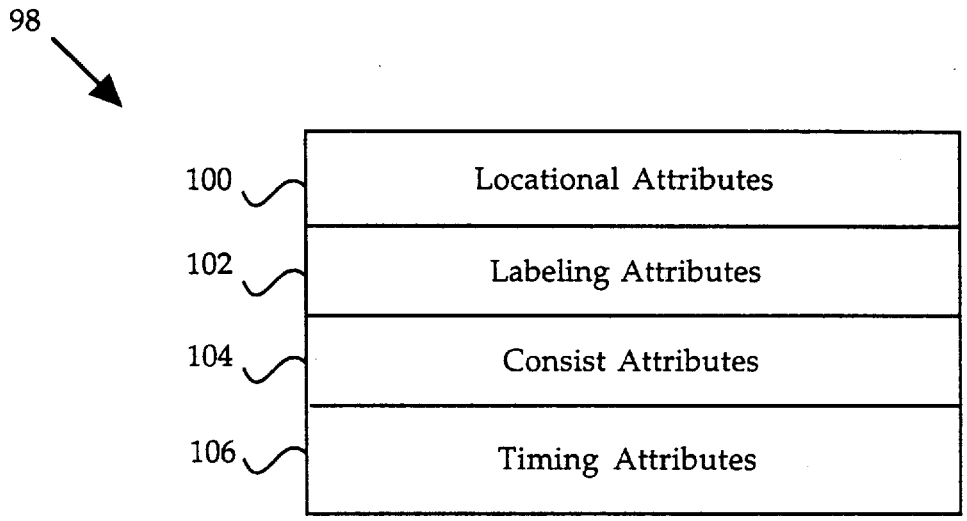
FIG. 7 is a block diagram of a preferred embodiment of a transport object data structure within the transport object library.

Referring now to FIG. 7, a block diagram of a preferred embodiment of a transport object data structure 98 within the transport object library 64 is shown. The data structure 98 comprises a first data field for storing the transport object's (70 through 89) locational attributes 100, a second data field for storing the transport object's (70 through 89) labeling attributes 102, a third data field for storing the transport object's (70 through 89) consist attributes 104 and a fourth data field for storing the transport object's (70 through 89) timing attributes 106. The actual data items that the transport objects (70 through 89) store within each of the data fields 100, 102, 104, 106 and the data items retrieved to effect the maps in the map object library 92 and the reports in the report object library 96 is described in detail below.

As introduced above, the TWS management unit 59 preferably comprises a set of executable program instructions for initiating and managing the operation of the TWS 40. More specifically, the TWS management unit 59 operation begins in response to a user signal received by the input device 50, after which the TWS management unit 59 preferably loads in and activates the CMO 90 and the transportation network map object 400 DLLs from the service object library 66, thus providing the user with a set of point-and-click icons through which to command the TWS 40 to selectively generate a variety of displays and reports, as is discussed in detail below. The TWS management unit 59 manages the transfer of control between the various DLLs stored in the transport object library 64 and the service object library 66 and responds to interrupt requests from either a DLL or the user. Upon an interrupt request, the TWS management unit 59 waits for the completion of any existing tasks before loading into the volatile memory 58 a new set of DLLs in response to the interrupt request. After completion of the requested function the TWS management unit 59 flushes out of the volatile memory 58 any DLL that is idle.

The transport objects (70 through 89) are preferably comprised of program instructions and data items, whose data items are stored within the transport object data structure 98. As discussed above, the program instructions within each of the transport objects (70 through 89) preferably comprise routines for obtaining and updating each of the transport object's (70 through 89) respective data items. What follows is a listing of the specific data items preferably acquired and updated by each of the transport objects (70 through 89) and where the data items are preferably stored within the transport object data structure 98.

Each terminal referenced by the terminal object 70 comprises: within the locational attributes data field 100 a terminal mile post and a geographic location (latitude/longitude); within the labeling attributes data field 102 a terminal name, a unique terminal ID, a train master external phone number, a train master internal phone number, a pit external phone number and a pit internal phone number; and within the consist attributes data field 104 a terminal type.

Each train referenced by the train object 72 comprises: within the locational attributes data field 100 a geographic location, a division code and a name of the corridor; within the labeling attributes data field 102 a unique train ID, an on-signal station name and a train name; within the consist attributes data field 104 a commodity carried code, a number of loaded cars, a number of empty cars, a weight in tons, a number of cars that carry automobiles, a number of top-only flat cars, a length of the train, a government permission number, a number of engines on the train, a type of crew and a power required to pull the train; and within the timing attributes data field 106 a train direction, a late train indicator, an on-signal time, a projected elapsed time, an actual elapsed time, crew's estimated time of arrival at next terminal, a crew's aggregate work hours, a train's terminal of origin and a train's terminal destination.

Each locomotive referenced by the locomotive object 74 comprises: within the locational attributes data field 100 a train identification and a shopped/stored; within the labeling attributes data field 102 a locomotive initial, a locomotive number filler, a locomotive number and a permanent service tag; within the consist attributes data field 104 a locomotive class, a miles left until fuel empty, a radio unit indicator, a number of axles and a high-speed truck count; and within the timing attributes data field 106 a form due code, a dead problem flag, an other problem flag, a next Q location/date, an alert level, an estimated time of arrival.

Each yard referenced by the yard object 76 comprises: within the locational attributes data field 100 a unique crew location ID and a primary direction; within the labeling attributes data field 102 a unique terminal ID, a terminal name, a unique yard ID and a yard name; and within the consist attributes data field 104 a yard type and a yard access level.

Each crew referenced by the crew object 78 comprises: within the locational attributes data field 100 a supply point and a destination; within the labeling attributes data field 102 a crew name and a crew ID; within the consist attributes data field 104 a crew occupation and a crew status; and within the timing attributes data field 106 a start time and an expiration-time.

Each car referenced by the car object 80 comprises: within the locational attributes data field 100 a train to which the car is connected; within the labeling attributes data field 102 a unique car identification; within the consist attributes data field 104 a number of system cars, a number of foreign cars, a number of private cars, a total number of cars, a car type and a car weight; and within the timing attributes data field 106 a car's associated scheduling information.

Each end-of-train device referenced by the end-of-train device object 82 comprises: within the locational attributes data field 100 a yard mile post; within the labeling attributes data field 102 an end-of-train device unique ID; within the consist attributes data field 104 a type, a tag status, an activity and an owner; and within the timing attributes data field 106 an activity time.

Each shop referenced by the shop object 84 comprises: within the locational attributes data field 100 a shop location; within the labeling attributes data field 102 a unique shop ID and a shop phone; within the consist attributes data field 104 a shop code, a shop description and a shop type; and within the timing attributes data field 106 a shop's schedule and performance information.

Each division referenced by the division object 86 comprises: within the locational attributes data field 100 a set of division boundaries; within the labeling attributes data field 102 a division ID and a division name; within the consist attributes data field 104 a set of division statistics; and within the timing attributes data field 106 a division's overall scheduling and performance information.

Each coal zone referenced by the coal zone object 87 comprises: within the locational attributes data field 100 a milepost; within the labeling attributes data field 102 a coal zone name and a unique ID; within the consist attributes data field 104 a number of loaded coal cars, a number of empty coal cars, a number of loaded coke cars, a number of empty coke cars, a number of loaded ore cars, a number of empty ore cars, a number of aggregate loaded cars, a number of aggregate empty cars, a number of MOW loaded cars, a number of MOW empty cars, a number of miscellaneous loaded cars, a number of miscellaneous empty cars, a total number of loaded cars and a total number of empty cars; and within the timing attributes data field 106 a coal zone's scheduling or performance information.

Each transportation network referenced by the transportation network object 88 comprises: within the locational attributes data field 100 a corner railpoint latitude/longitude, an intersection railpoint latitude/longitude, a distance between railpoints and a direction between railpoints.

Each computerized train control referenced by the computerized train control object 89 comprises: within the locational attributes data field 100 a track segment length, a track intersection and a train position; within the labeling attributes data field 102 a train track ID; and within the consist attributes data field 104 a signal setting and an intersection switch position.

What follows is a discussion of the operation of each of the map objects (400 through 412) within the map object library 92 and each of the report objects (414 through 420) within the report object library 96. The operation of each of the map objects (400 through 412) and report objects (414 through 420) is initiated in response to the user's selection of an icon via the input device 50 as monitored by the CMO 90. Should any of the map objects (400 through 412) or report objects (414 through 420) require additional information from the user, the map objects (400 through 412) or report objects (414 through 420) pass on such requests to the CMO 90, which then generates an appropriate dialog window on the output device 52 and prompts the user to enter a response. Whenever a transport object (70 through 89) is tasked with providing either the map objects (400 through 412) or report objects (414 through 420) with some requested information, each of the transport objects (70 through 89) preferably employs well known mathematical calculations and conventionally known data base searching and matching techniques to provide the information requested. Preferably, the individual actions of a particular map object (400 through 412) or report object (414 through 420) do not erase or modify what was previously displayed on the output device 52 unless the actions of the particular map object (400 through 412) or report object (414 through 420) conflict with what was previously displayed. Also, each of the map objects (400 through 412) and report objects (414 through 420) selectively generates alerts in response to user selected warning criteria. To generate an alert, the map object (400 through 412) or the report object (414 through 420) prompts the user to specify a value or range of values for any selected map or report data item, preferably coinciding with the data item's nominal or expected performance. After which, the map object (400 through 412) or the report object (414 through 420) monitors the real-time value of the data item. If the data item deviate from the user specified value or range of nominal or expected values, an alert signal is generated and the map object (400 through 412) or report object (414 through 420) warns the user of the variance by preferably both an audible and a visual signal on the output device 52.

The transportation network map object 400 generates a variety of maps in response to criteria selected by the user. To generate a map of a portion of the transportation network 20, the transportation network map object 400 prompts the user to select the map's boundaries. Next, the transportation network map object 400 requests from the transportation network object's 88 locational attributes data field 100 a latitude and longitude for each of a set of corner railpoints and intersection railpoints and a distance and direction between each of the railpoints that fall within the map's boundaries. After which, the transportation network map object 400 organizes and connects the various railpoints to form the map on the output device 52. To generate a particular division within the map, the transportation network map object 400 prompts the user to select the particular division and then retrieves the boundaries of the particular division selected from the division object's 86 locational attributes data field 100. Next the transportation network map object 400 uses the division's boundaries to generate the particular division on the output device 52 using the same routine discussed above to generate the map of a portion of the transportation network 20. To incrementally zoom in or out on various portions of the map the transportation network map object 400 prompts the user for a zoom increment and therefrom creates a set of zoom boundaries. The transportation network map object 400 then uses the zoom boundaries to generate the particular division on the output device 52 using the same routine discussed above to generate the map of a portion of the transportation network 20. Subsequently the transportation network map object 400 generates the zoomed map on the output device 52.

The train map object 404 selectively generates on the output device 52 a variety of graphical information related to a set of trains. To locate a specific train on the map, the train map object 404 prompts the user to specify a train by one of the train's labeling attributes. The train map object 404 then compares the specified labeling attribute with the data items in the train object's 72 labeling attributes data field 102 and retrieves the train's latitude and longitude from the train object's 72 locational attributes data field 100 if there is a match. Subsequently, the train map object 404 highlights the selected train on the map. To locate a type or owner of a train on the map, the train map object 404 prompts the user to specify either a train type or types (i.e. quality, coal, empty, grain, merchandise, intermodal, automotive, local, work, passenger, extra and/or foreign) or an owner. The train map object 404 then provides the specified consist attribute or attributes to the train object 72 and retrieves the latitude and longitude of each train within the type or types or owned by the specified owner from the train object's 72 locational attributes data field 100. Next, the train map object 404 highlights the selected train type or types on the map. To generate an identification number beside each train currently displayed on the map, train map object 404 retrieves the identification number of each train from the train object's 72 labeling attributes data field 102. Subsequently the train map object 404 places the identification numbers next to each of the trains on the map. To generate a time elapsed since the train departed from its point of origin beside each train, the train map object 404 retrieves the time elapsed since the train departed from its point of origin from the train object's 72 timing attributes data field 114. Subsequently the train map object 404 places the time elapsed since the train departed from its point of origin next to each of the trains on the map. To generate a map showing which trains are late, the train map object 404 first prompts the user to select a first variable "A" for those trains that are more than "A" hours late, a second variable "B'" for those trains that are less than "B" hours late. The train map object 404 then compares these timing attributes with the data items in the train object's 72 timing attributes data field 106 and retrieves a latitude and longitude for each train and assigns the train to either a first group of trains that are more than "A" hours late, a second group of trains that are between "A" and "B" hours late, and a third group of trains that are less than "B" hours late. Next, the train map object 404 displays on the map the first, second and third group of trains at their respective latitudes and longitudes, using a different color-coded icon for each of the three groups.

The terminal map object 406 generates and displays on the output device 52 a variety of information related to a set of terminals. To locate a specific terminal on the map, the terminal map object 406 prompts the user to specify a terminal by one of the terminal's labeling attributes. The terminal map object 406 then compares the specified labeling attribute with the data items in the terminal object's 70 labeling attributes data field 102 and retrieves the terminal's latitude and longitude from the terminal object's 70 locational attributes data field 100 if there is a match. Subsequently, the terminal map object 406 highlights the selected terminal on the map. To generate either a milepost, a city and state or a mnemonic beside each terminal displayed on the map, terminal map object 406 prompts the user to select a labeling type, passes this labeling attribute to the terminal object 70 and retrieves the specified label for each terminal from the terminal object's 70 locational attributes data field 100. Subsequently the terminal map object 406 places the specified label next to each of the terminals on the map. To locate a type of terminal on the map, the terminal map object 406 prompts the user to specify a terminal type or types (i.e. major, intermediate or minor). The terminal map object 406 then provides the specified consist attribute or attributes to the terminal object 70 and retrieves the latitude and longitude of each specified terminal type or types from the terminal object's 70 locational attributes data field 100. Next, the terminal map object 406 highlights the selected terminal type or types on the map. To generate a 30 hour car summary, the terminal map object 406 prompts the user for an upper and lower range of cars residing in a terminal for more than 30 hours, compares this consist attribute information with the data items in the train object's 72 consist attribute data field 104, and retrieves from the terminal object's 70 locational attributes data field 100 a latitude and longitude for a first group of terminals having less then the lower range of cars located within the terminal for more than 30 hours, a latitude and longitude for a second group of terminals having between the upper and lower range of cars located within the terminal for more than 30 hours, and a latitude and longitude for third group of terminals having greater than the upper range of cars located within the terminal for than 30 hours. Subsequently terminal map object 406 generates a first icon at the first group of terminals, a second icon at the second group of terminals, and a third icon at the third group of terminals on the map. To generate a terminal delay profile for each of the terminals, the terminal map object 406 retrieves from the train object's 72 timing attributes data field 106 a set of terminal train delay reasons (for example no crew available). Subsequently the terminal map object 406 calculates and displays next to each terminal, having an a delay, the reasons for each terminal's delay preferably using a pie chart icon whose relative portions represent the relative magnitude of each delay reason. To selectively generate on the map those terminals with trains projected ready and not called, the terminal map object 406 prompts the user to select a number, "N," of trains and retrieves from the train object's 72 timing attributes data field 106 a total number of trains ready and not called above the user selected number, "N," of trains and a total number of trains ready and not called below the user selected number, "N," of trains. Next the terminal report object 416 highlights in red on the map those terminals whose total number of trains ready and not called is above the user selected number, "N," of trains. To generate a locomotive supply and demand profile for each of the terminals, the terminal map object 406 retrieves a number of terminals having an excess supply of or an excess demand for locomotives from the locomotive object's 74 consist attributes data field 104. Subsequently the terminal map object 406 displays a first icon next to those terminals having an excess supply of locomotives and a second icon next to those terminals having an excess demand for locomotives on the map.

The coal car map object 408 selectively generates on the output device 52 a variety of information related to a set of coal zones. To generate a coal zone brief next to each coal zone name on the map, the coal car map object 408 prompts the user to enter a number, "L," representing a number of coal zone loads and empties over the user entered number, "L." The coal car map object 408 then compares the consist attributes information with the data items in the coal zone object's 87 consist attributes data field 104 and calculates the number of loads and empties over the user entered number, "L," for each coal zone. Subsequently the coal car map object 408 displays icons next to each coal zone name indicating whether the coal zone's trains contains loads and/or empties over the user selected number.

The locomotive map object 410 selectively generates on the output device 52 a variety of information related to a set of locomotives. To locate a specific locomotive on the map, the locomotive map object 410 prompts the user to specify a locomotive by one of the locomotive's labeling attributes. The locomotive map object 410 then compares the specified labeling attribute with the data items in the locomotive object's 74 labeling attributes data field 102 and retrieves the locomotive's latitude and longitude from the locomotive object's 74 locational attributes data field 100 if there is a match. Next, the locomotive map object 410 highlights the selected locomotive on the map. To locate a type of locomotive on the map, the locomotive map object 410 prompts the user to specify a locomotive type or types (i.e., CW44, CW40, SD50, B36, GP40 and so on). The locomotive map object 410 then provides the specified consist attribute or attributes to the locomotive object 74 and retrieves the latitude and longitude of each locomotive within the type or types from the locomotive object's 74 locational attributes data field 100. Subsequently, the locomotive map object 410 highlights the selected locomotive type or types on the map. To generate a number of trains and terminals with "N" or more locomotives, the locomotive map object 410 prompts the user for the value of "N" and retrieves the specified consist information from the locomotive object's 74 locational attributes data field 100. Subsequently, the locomotive map object 410 displays the trains and terminals with "N" or more locomotives.

The computerized train control map object 412 selectively generates on the output device 52 a variety of information related to a set of railroad track segments. To view railroad tracks in a particular yard or within a particular railroad track segment, the computerized train control map object 412 prompts the user to specify either the particular yard or railroad track segment and retrieves from the computerized train control object's 89 locational attributes data field 100, labeling attributes data field 102 and consist attributes data field 104 a train track ID, a track segment length, a track intersection location, a train position, an intersection signal setting and a track intersection switch position. Next, the computerized train control map object 412 presents the railroad tracks, highlights those track segments which contain trains, identifies the position of the track intersection switches and the intersection signal settings on the map.

The operation of the report objects (414 through 420) within the report object library 96 are now discussed. The train report object 414 selectively generates on the output device 52 a variety of information related to a set of trains. To generate a report on which trains are late, the train report object 414 first prompts the user to select a first group of trains that are more than "A" hours late, a second group of trains that are between "A" and "B" hours late and a third group of trains that less than "B" hours late. The train report object 414 then compares these timing attributes with the data items in the train object's 72 timing attributes data field 106 and retrieves a train labeling attribute for each train that falls within each group from the train object's 72 labeling attributes data field 102. Subsequently, the train report object 414 calculates and displays the first, second and third group of trains in a report containing the number of trains in each group and a percentage of a total of all the trains in each group. The train report object 414 also calculates and displays the total number of all trains and their average delay. To generate a report on a particular customer's trains, the train report object 414 prompts the user to select the particular customer. The train report object 414 then retrieves from the train object's 72 locations attributes data field 100 and consist attributes data field 104 a number of the customer's trains currently running, at their point of origin, on-line of road, in intermediate stations, whose status is not available, a number of the customer's trains carrying private sets, carrying system sets, carrying leased sets and whose set data items are not available. After which the train report object 414 presents the aforementioned information in a report on the output device 52. To generate a train brief report, the train report object 414 prompts the user to select a particular train. The train report object 414 then retrieves from the train object's 72 locations attributes data field 100, labeling attributes data field 102, consist attributes data field 104 and timing attributes data field 106 the train's identification, name, last on-signal point and time, last train station and time, on-time performance, loads, empties, tonnage, length, autos, trailers on a flat car, elapsed time, projected time and train load permit. Next the train report object 414 presents the aforementioned information in a report on the output device 52. To generate a train status report, the train report object 414 prompts the user to select a particular train. The train report object 414 then retrieves from the train object's 72 locations attributes data field 100, labeling attributes data field 102, consist attributes data field 104 and timing attributes data field 106 the train's identification, remarks, name, origin, destination, type, current station, next station, schedule, estimated time of arrival, SB, projected tons, projected time, offered time, called time, departed time, arrived time, last on-signal point, last on-signal time, on-time performance, loads, empties, horsepower, tons, horsepower per trailing ton, pig, auto, feet, init number, sequence number in consist, whether locomotive is dead or isolated to save fuel, tag, direction, notes, class, seats, last fueling station, mileage from last fueling station, date of last fueling, quality inspection, mechanical failure codes, free-form train notes, time stamp when remarks are entered, and user identification of person entering notes. Subsequently the train report object 414 presents the aforementioned information in a report on the output device 52. To generate a train consist report, the train report object 414 prompts the user to select a particular train. The train report object 414 then retrieves from the train object's 72 and the car object's 80 locational attributes data field 100, labeling attributes data field 102 and consist attributes data field 104 the train's identification, control number, from city/state, to city/state, message type, time stamp, loads, empties, tons, length, planned blocks, actual blocks, a number of cars, an order of cars, a type of car, contents of a car, and destination of a car. After which the train report object 414 presents the aforementioned information in a report on the output device 52. The train report object 414 also presents an idealized but sequentially accurate graphical representation of the selected train using the number of cars, the order of cars, the type of car, the contents of a car, and the destination of a car data items. This enable users to see the actual positioning of the cars within the selected train as a series of color coded rectangles lined up in a row and labeled with each car's unique ID. To generate a train performance report, the train report object 414 prompts the user to select a particular train. The train report object 414 then retrieves from the train object's 72 locations attributes data field 100 and timing attributes data field 106 an amount of time by which the train is ahead of schedule or is behind schedule for an arrival at a station or a departure at a station, for each station along the train's scheduled routes. Next the train report object 414 presents the aforementioned information in a report on the output device 52.

The terminal report object 416 presents on the output device 52 a variety of information related to a set of terminals. To generate a terminal status report, the terminal report object 416 prompts the user to select a particular terminal. The terminal report object 416 then retrieves from the terminal object's 70 locations attributes data field 100, labeling attributes data field 102, consist attributes data field 104 and timing attributes data field 106 the terminal's city, station, mile post, 30 hour car summary, on-time performance, car scheduling compliance, and phone numbers for the train master and the pit. Subsequently the terminal report object 416 presents the aforementioned information in a report on the output device 52. To generate a terminal on-time performance report, the terminal report object 416 prompts the user to select a terminal or set of terminals and a set of train types. The terminal report object 416 then retrieves the appropriate data items from the train object's 72 locations attributes data field 100 and timing attributes data field 106 and calculates a percentage of the selected train types whose originated on-time performance exceeds or falls below a selected percentage and an average of all of the train types' originated on-time performance for the selected set of terminals. After which the terminal report object 416 presents the aforementioned information in a report on the output device 52. To generate a 30 hour car summary report, the terminal report object 416 prompts the user for a selected range of cars and then retrieves from the terminal object's 70 locations attributes data field 100, labeling attributes data field 102, consist attributes data field 104 and timing attributes data field 106 a number and a percentage of terminals having less then, between and greater than a selected range of cars which have been located within a terminal for more than 30 hours and a number and a percentage of terminals for whom such information is not available. Next the terminal report object 416 presents the aforementioned information in a report on the output device 52. To generate a system wide or a terminal delay report, the terminal report object 416 prompt the user to select either the system wide or a particular terminal delay report and retrieves from the train object's 72 timing attributes data field 106 a total number of trains delayed, a total delay time, a delay description, a percentage of trains delayed and a percentage of the total delay time. Subsequently the terminal report object 406 preferably presents the aforementioned information in either a system wide or a selected terminal report. To generate a terminals with trains projected ready and not called report, the terminal report object 416 prompts the user to select a number of trains and retrieves from the train object's 72 timing attributes data field 106 a total number of trains ready and not called above the user selected number of trains and a total number of trains ready and not called below the user selected number of trains. After which the terminal report object 416 presents the aforementioned information in a report. To generate a terminal timeline report, the terminal report object 416 prompts the user to select a particular terminal and retrieves from the train object's 72 timing attributes data field 106 all of the arrival times and departure times within a fixed time period for the particular terminal. Those skilled in the art will recognize that the time period need not be fixed and in an alternate embodiment can be a variable. Next the terminal report object 416 presents the aforementioned information in a report. To generate a terminal status report, the terminal report object 416 prompts the user to select a particular terminal and retrieves from the terminal object's 70 or the train object's 72 locational attributes data field 100, labeling attributes data field 102, consist attributes data field 104 and timing attributes data field 106 trains in the arrival yard, current shift information, a measure of work, trains in the departure yard and trains due in eight hours. Subsequently the terminal report object 416 presents the aforementioned information in a report. To generate a locomotive supply and demand report for each of the terminals, the terminal report object 416 retrieves a number of terminals having an excess supply of or an excess demand for locomotives and a set of projected supply and demand for locomotives for each terminal from the terminal object's 70 or the train object's 72 consist attributes data field 104 and timing attributes data field 106. After which the terminal report object 416 displays a total number of terminals having an excess supply of locomotives, a total number of terminal having excess demand for locomotives, a projected supply of and demand for locomotives for all terminals over a weekly time period and a daily time period in a report on the output device 52.

The coal car report object 418 presents on the output device 52 a variety of information related to a set of coal zones. To generate a coal car turns per month report, the coal report object 418 retrieves from the coal zone object's 87 consist attributes data field 104 and timing attributes data field 106 a number of loads, a fleet size, a number turns per month and a projected number of turns per month for system coal cars, foreign coal cars, private coal cars and a total of all coal cars. Next the coal report object 416 presents the aforementioned information in a report on the output device 52. To generate a coal zone brief report, the coal report object 418 prompts the user to select a coal zone and retrieves from the coal zone object's 87 consist attributes data field 104 a number of loads, empties, and totals for each coal commodity, such as coal, coke, ore, aggregate, MOW and miscellaneous within the coal zone. Subsequently the coal report object 416 presents the aforementioned information in a report on the output device 52. To generate a coal car information by zone report, the coal report object 418 retrieves from the coal zone object's 87 consist attributes data field 104, for each coal zone, a number of loads and empties for each coal commodity and a total number of loads and empties. After which the coal report object 416 presents the aforementioned information in a report on the output device 52. To generate a coal car information by system report, the coal report object 418 retrieves from the coal zone object's 87 consist attributes data field 104 a number of system, private and foreign coal cars, loads and empties, carrying each coal commodity, and a total number of loads and empties for each coal commodity as well as for all coal commodities. Next the coal report object 416 presents the aforementioned information in a report on the output device 52. To generate a coal car information by division report, the coal report object 418 prompts the user for a selected set of coal commodities and retrieves from the coal zone object's 87 consist attributes data field 104 a total number of loads and empties for each division for the selected set of coal commodities. Subsequently the coal report object 416 presents the aforementioned information in a report on the output device 52.

The locomotive report object 420 presents on the output device 52 a variety of information related to a set of locomotives. To generate a report on how many terminals or trains have "N" or more locomotives, the locomotive report object 420 first prompts the user to select a number "N." The locomotive report object 420 then compares this consist attribute with the data items in the train object's 72 consist attributes data field 104 and calculates a total number of terminals and trains having "N" or more locomotives. After which, the locomotive report object 420 presents the aforementioned information on the output device 52. To generate a locomotive utilization report, the locomotive report object 420 prompts the user to select a locomotive type and retrieves from the locomotive object's 74 timing attributes data field 106 a number of days active, idle, shop/stored and other over a first specified time period, and an average miles for each locomotive over a second specified time period. Next, the locomotive report object 420 presents the aforementioned information on the output device 52. To generate a locomotive dwell time report, the locomotive report object 420 prompts the user for a standard dwell time, compares the standard dwell time to the data items in the train object's 72 locational attributes data field 100 and timing attributes data field 106 and calculates a number of terminals with locomotives exceeding a time standard for movement within the terminal. Subsequently, the locomotive report object 420 presents the aforementioned information on the output device 52.

In addition to the reports generated above, additional sub-reports are preferably generated by selecting certain icons within the reports described above. For instance, additional transportation network information maintained by the yard object 76 and the shop object 84 can be accessed through reports generated by the terminal report object 416 and additional information maintained by the crew object 78 and the end of train device object 82 can be accessed through reports generated by the train report object 414. Those skilled in the art will further recognize that additional information may be incorporated into the aforementioned reports and/or new reports from time to time as the informational needs of the transportation network grows.

While the preferred embodiment of the transport objects (70 through 89) and the report objects (400 through 420) has been provided, those skilled in the art will recognize that the various data items necessary to generate the aforementioned maps and reports could be alternately stored in different data fields (100 through 106) than those specified above or even in additional new data fields.

Figure 8A:
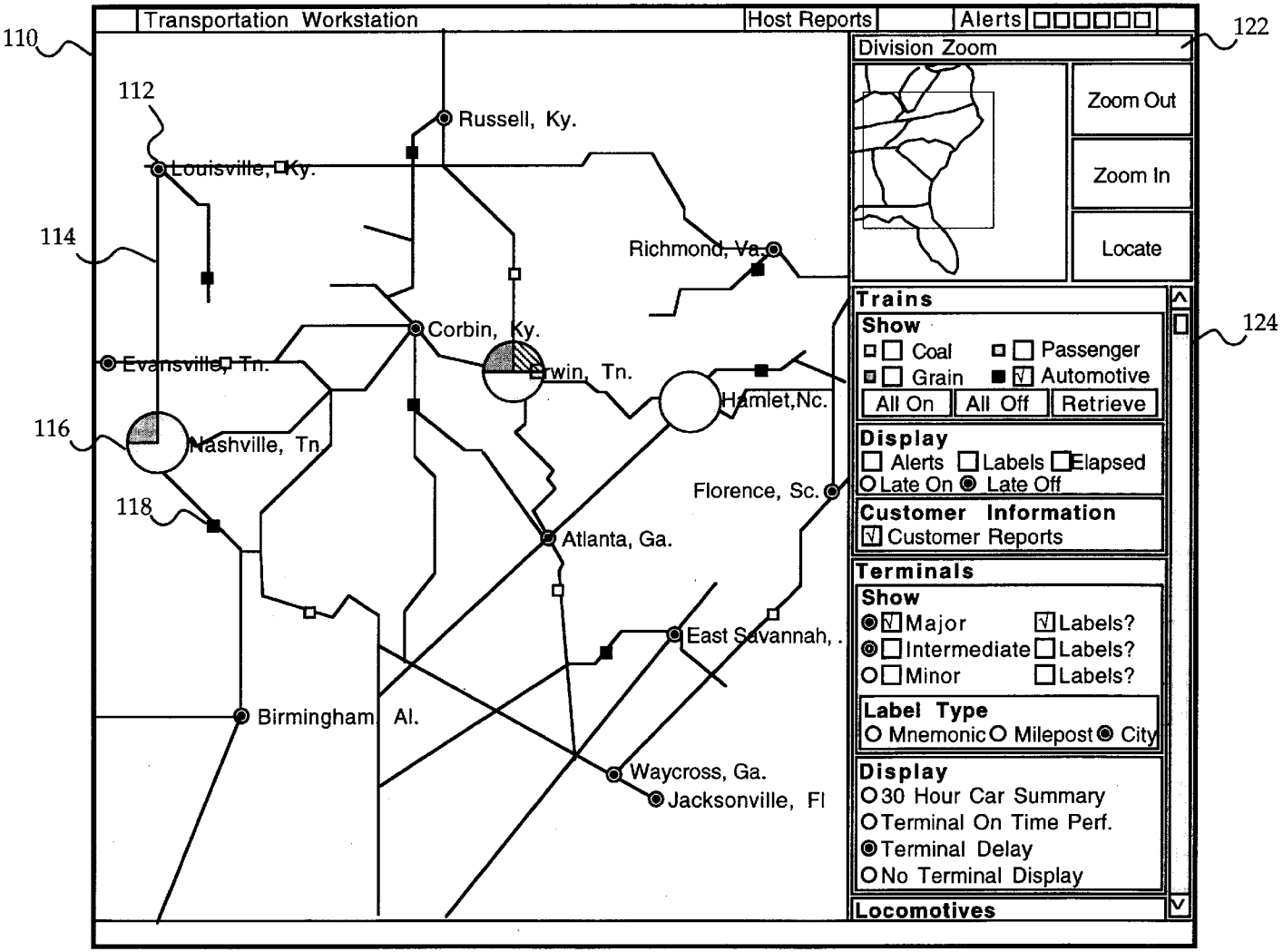
FIGS. 8*a*, 8*b*, 8*c*, 8*d*, 8*e* and 8*f* are a graphical layout of a preferred embodiment of a set of maps, reports and context menus as viewed on an output device.
Figure 8B:
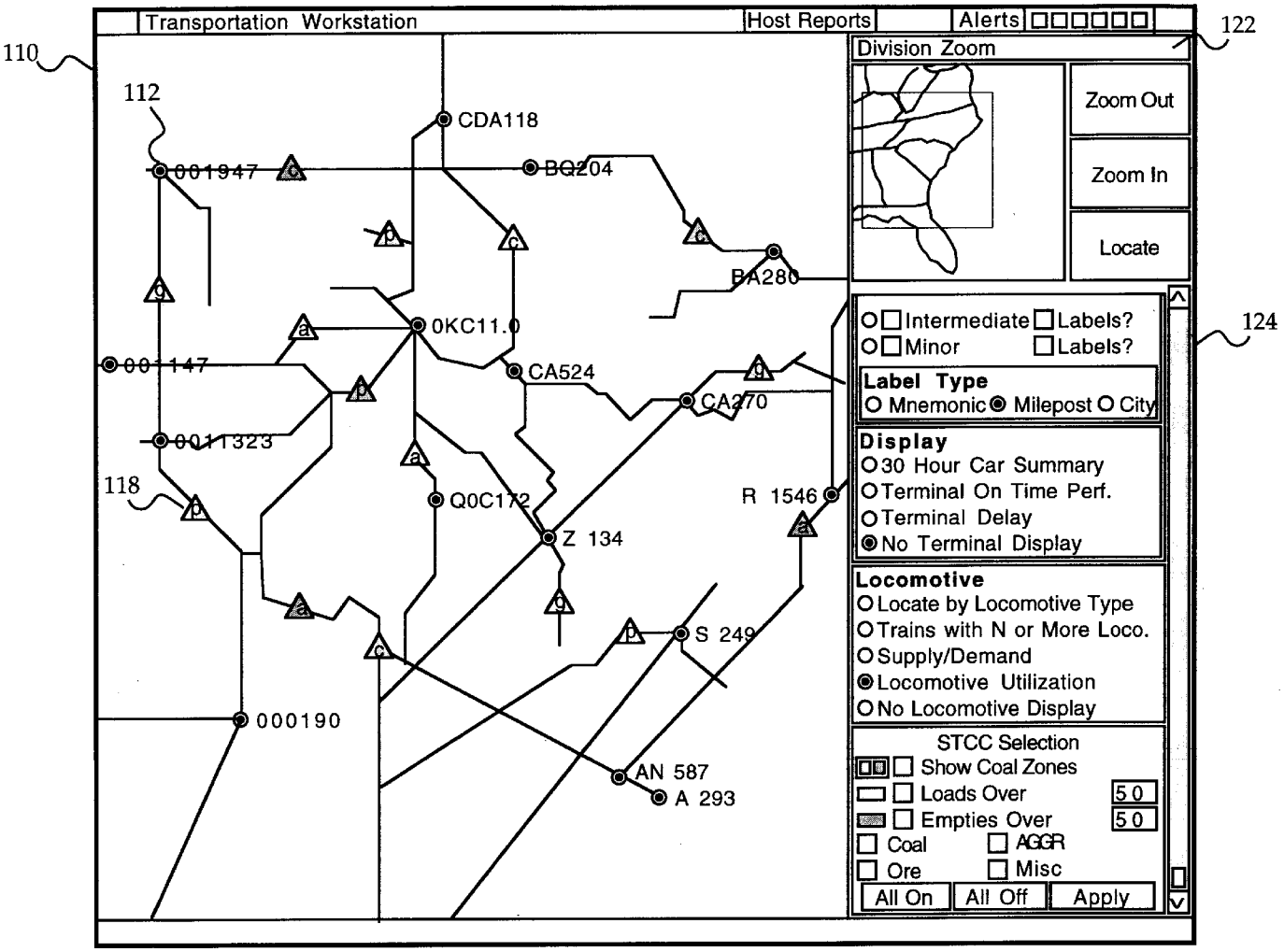
Figure 8C:
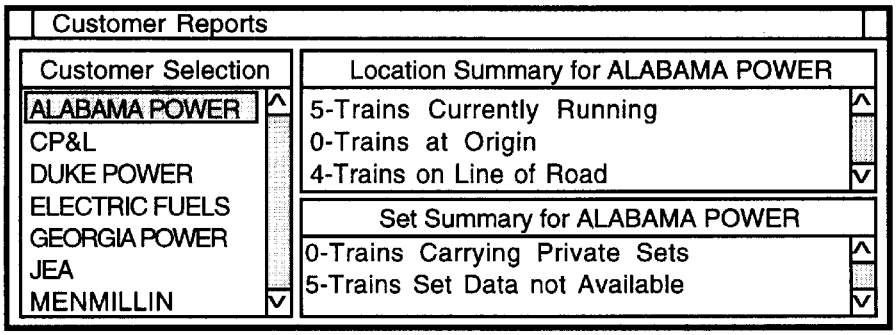

Referring now to FIGS. 8*a*, 8*b* and 8*c*, a graphical layout of a preferred embodiment of a set of maps, reports and context menus as viewed on the output device 52 is shown. Those skilled in the art will recognize that the information presented in these maps, reports and context menus may, in alternate embodiments, vary as to their form and/or information content.

FIG. 8*a* shows a preferred map 110, a preferred terminal 112, a preferred railroad track segment 114, a preferred terminal performance pie chart 116, a preferred train 118, a preferred division zoom panel 122, and a preferred context menu 124. In this preferred embodiment, the preferred division zoom panel 122 permits users to select the boundaries of the preferred map 110. In the preferred division zoom panel 122, a reduced size map of a geographic area is shown with a box outlining a region on the reduced size map which represents the preferred map 110 as shown. The preferred map 110 comprises a set of railroad track segments, of which the preferred railroad track segment 114 is one. From the preferred context menu's 124 "trains-show" portion, it can be seen that the user has selected "automotive," resulting in only the "automotive" trains being shown on the preferred map 110 as a "square," of which the preferred train 118 is one. Each train type shown on the preferred map 110 is preferably assigned a different square color, which since only "automotive" trains are shown, only "black" squares appear on the preferred map 110. From the preferred context menu's 124 "trains-display" portion, it can be seen that the user has selected "late-off," resulting in the "automotive" train's on-time performance not being shown on the preferred map 110. More on this later. From the preferred context menu's 124 "trains-customer information" portion, it can be seen that the user has selected "customer reports," resulting in the generation of a preferred customer report shown in FIG. 8*c* and discussed below. From the preferred context menu's 124 "terminals-show" portion, it can be seen that the user has selected "major," resulting in only the "major" terminal being shown on the preferred map 110, of which the preferred terminal 112 is one. From the preferred context menu's 124 "terminals-label type" portion, it can be seen that the user has selected "city," resulting in the terminals being labeled by their "city and state" as shown on the preferred map 110, which for the preferred terminal 112 is "Louisville, Ky." From the preferred context menu's 124 "terminal-display" portion, it can be seen that the user has selected "terminal delay," resulting in the preferred terminal performance pie chart 116 being shown on the preferred map 110 next to only those "major" terminals experiencing a delay, of which "Nashville, Tenn." is one. As discussed above, each segment of the pie chart represents a delay reason and a relative magnitude of the delay reason. Selecting the "terminal delay" box on the preferred context menu 124 also results in the generation of a preferred system delay summary report shown in FIG. 8*d* and discussed below.

FIG. 8*b* shows the preferred map 110, the preferred terminal 112, the preferred train 118, the preferred division zoom panel 122, and the preferred context menu 124. Since in this example, it can be seen that the user has not selected a new set of boundaries for the preferred map 110 through the preferred division zoom panel 122, the preferred map 110 presented on the output device 52 has not changed. From the preferred context menu's 124 "trains-display" portion (not shown since the user has "scrolled" down the preferred context menu 124), it can be seen that the user has selected "late-on," resulting in the "automotive" train's on-time performance being shown by "color-coded triangles" on the preferred map 110 and representing a number of hours the train is late as described in a performance totals for trains displayed report shown in FIG. 8*e* and discussed below. In this example the preferred train 118 is color-coded by a medium gray triangle meaning that it is more than four hours late. The user has also made a change in the preferred context menu's 124 "terminals-label type" portion, by now selecting "milepost" instead of "city," resulting in each of the terminals being labeled by their "milepost" as shown on the preferred map 110, which for the preferred terminal 112 is "001947." From the preferred context menu's 124 "terminal-display" portion, it can be seen that the user has now selected "no terminal display," resulting in the removal of the preferred terminal performance pie chart 116 from the preferred map 110 and the removal of the preferred system delay summary report shown in FIG. 8*d* from the output device 52. From the preferred context menu's 124 "locomotive" portion, it can be seen that the user has selected "locomotive utilization," resulting in the generation of a preferred locomotive class utilization report shown in FIG. 8*f* and discussed below.

As introduced above, FIG. 8*c* shows the preferred customer report. In this report the train report object 414 prompts the user select a customer, after which the train report object 414 generates a list of how many of the customer owned trains are currently running, at their origin, on line of road, carrying private sets and whose set data is not available. Those skilled in the art will recognize that a lesser or a greater amount of information could have been provided in this report.

Figure 8D:
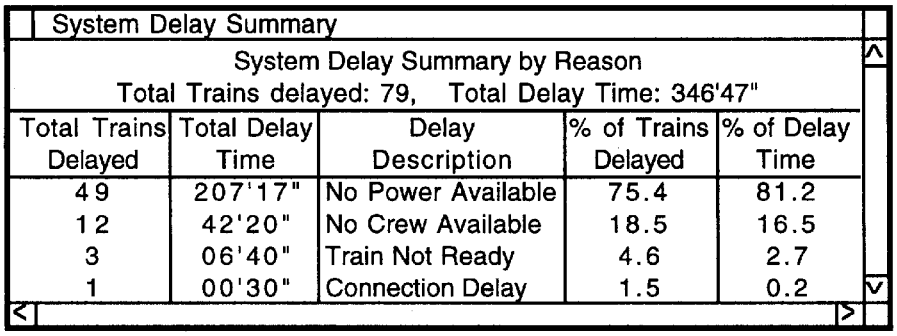

FIG. 8*d* shows the preferred system delay summary report. In this report the terminal report object 416 generates a table showing a total of trains delayed, a total delay time, a delay description, a percentage of trains delayed and a percentage of delay time. Those skilled in the art will recognize that a lesser or a greater amount of information could have been provided in this report.

Figure 8E:
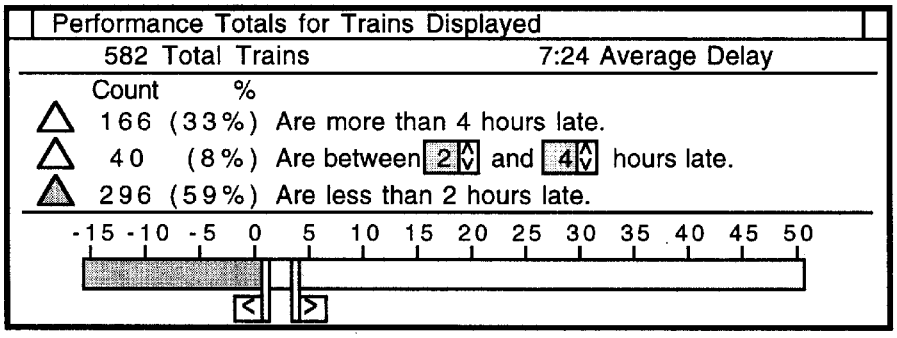

FIG. 8*e* shows the preferred performance totals for trains displayed report. In this report the train report object 414 generates a table showing a total and a percentage of displayed trains late more than 4 hours, between 2 and 4 hours and less than 2 hours. Those skilled in the art will recognize that a lesser or a greater amount of information could have been provided in this report.

Figure 8F:
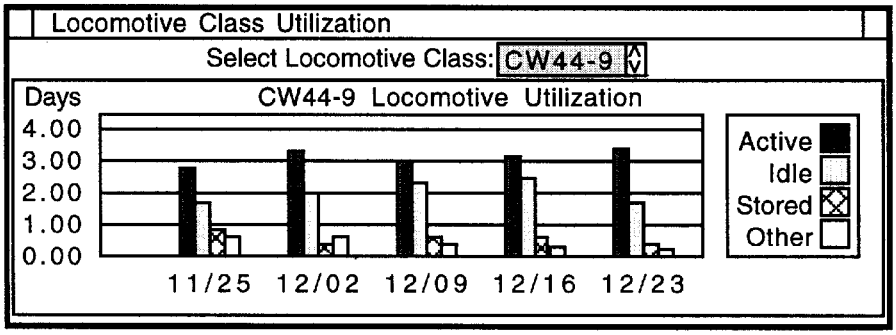

FIG. 8*f* shows the preferred locomotive class utilization report. In this report the locomotive report object 420 prompts the user to select a locomotive class and then generates a bar chart showing a total number of days each week that the selected class of locomotive was either active, idle, stored or other. Those skilled in the art will recognize that a lesser or a greater amount of information could have been provided in this report.

Figure 9A:
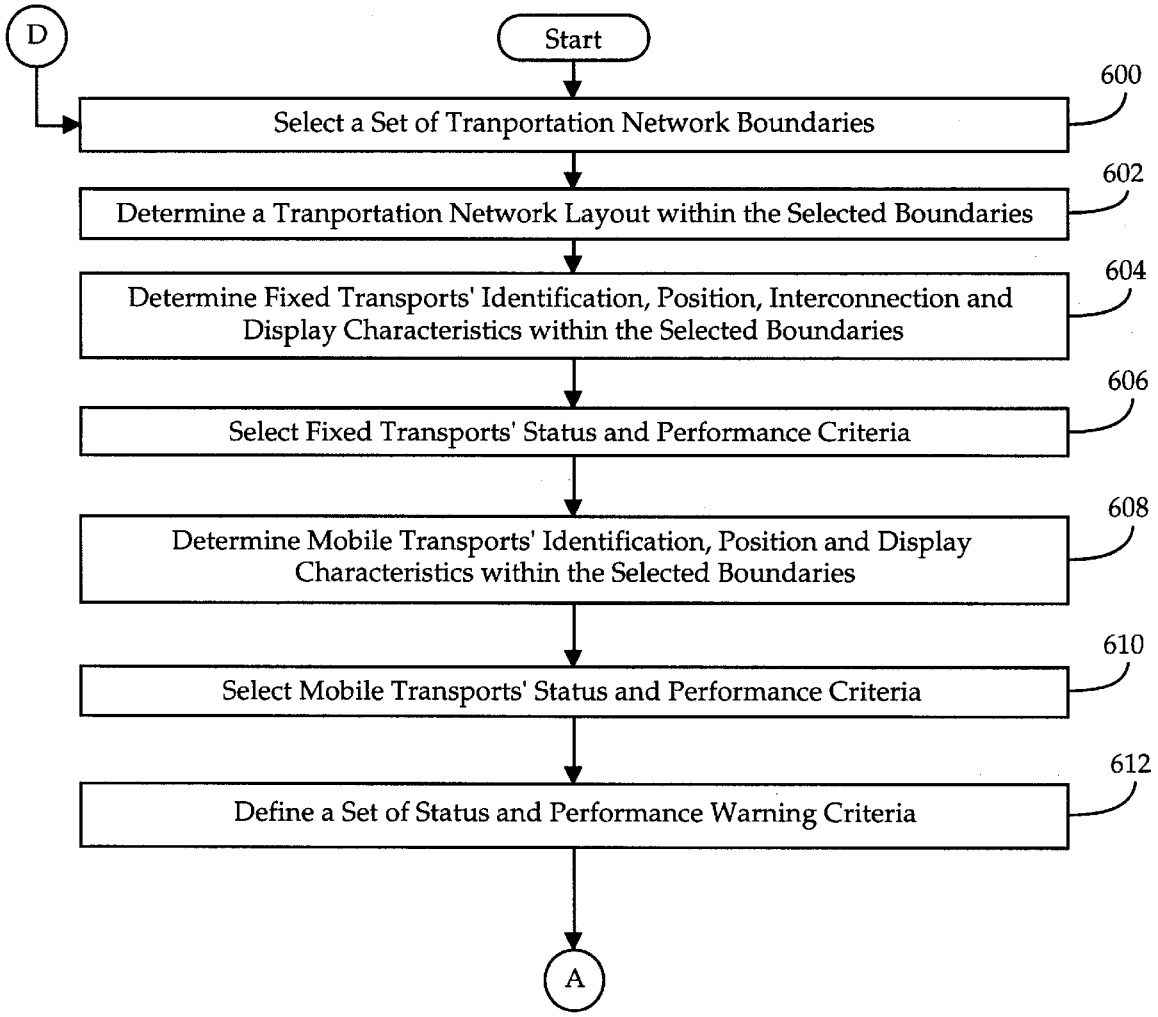
FIGS. 9*a*, 9*b* and 9*c* are a flowchart of a preferred method for object based railroad transportation network management.

Referring now to FIG. 9*a*, a flowchart of a preferred method for object based railroad transportation network management is shown. The preferred method is preferably the same for each map object (400 through 412) or report object (414 through 420) regardless of which map object (400 through 412) or report object (414 through 420) is generating an output display. The preferred method begins in step 600, where the map object (400 through 412) or the report object (414 through 420) prompts the user to select, a set of transportation network 20 boundaries, in the manner described above. Step 600 thus specifies which portion of the transportation network 20 the TWS 40 will either present on the map or include in a report. In step 602, the transportation network map object 400 determines a transportation network layout within the selected boundaries, in the manner described above and in preparation for displaying the map if so required. In step 604, either the map object (400 through 412) or the report object (414 through 420) determines the fixed transports' identification, position, interconnection and display characteristics within the selected boundaries, in the manner described above. The fixed transports' identification information is found in the labeling attributes data field 102, the position and interconnection information is found in the locational attributes data field 100, and the display characteristics are either map object (400 through 412) specified, report object (414 through 420) specified or found in the labeling attributes data field 102. In step 606, the map object (400 through 412) or report object (414 through 420) prompts the user to select the fixed transports' status and performance criteria, in the manner discussed above. In step 608, either the map object (400 through 412) or the report object (414 through 420) determines the mobile transports' identification, position and display characteristics within the selected boundaries, in the manner described above. The mobile transports' identification information is found in the labeling attributes data field 102, the position information is found in the locational attributes data field 100, and the display characteristics are either map object (400 through 412) specified, report object (414 through 420) specified or found in the labeling attributes data field 102, as is discussed above. In step 610, the map object (400 through 412) or report object (414 through 420) prompts the user to select the mobile transports' status and performance criteria, in the manner discussed above. In step 612, either the map object (400 through 412) or the report object (414 through 420) retrieves either a system-defined or user-defined set of status and performance warning criteria referencing those data items that the map object (400 through 412) or the report object (414 through 420) monitors, as was discussed above. The preferred method continues with step 614 in FIG. 9*b*.

Figure 9B:
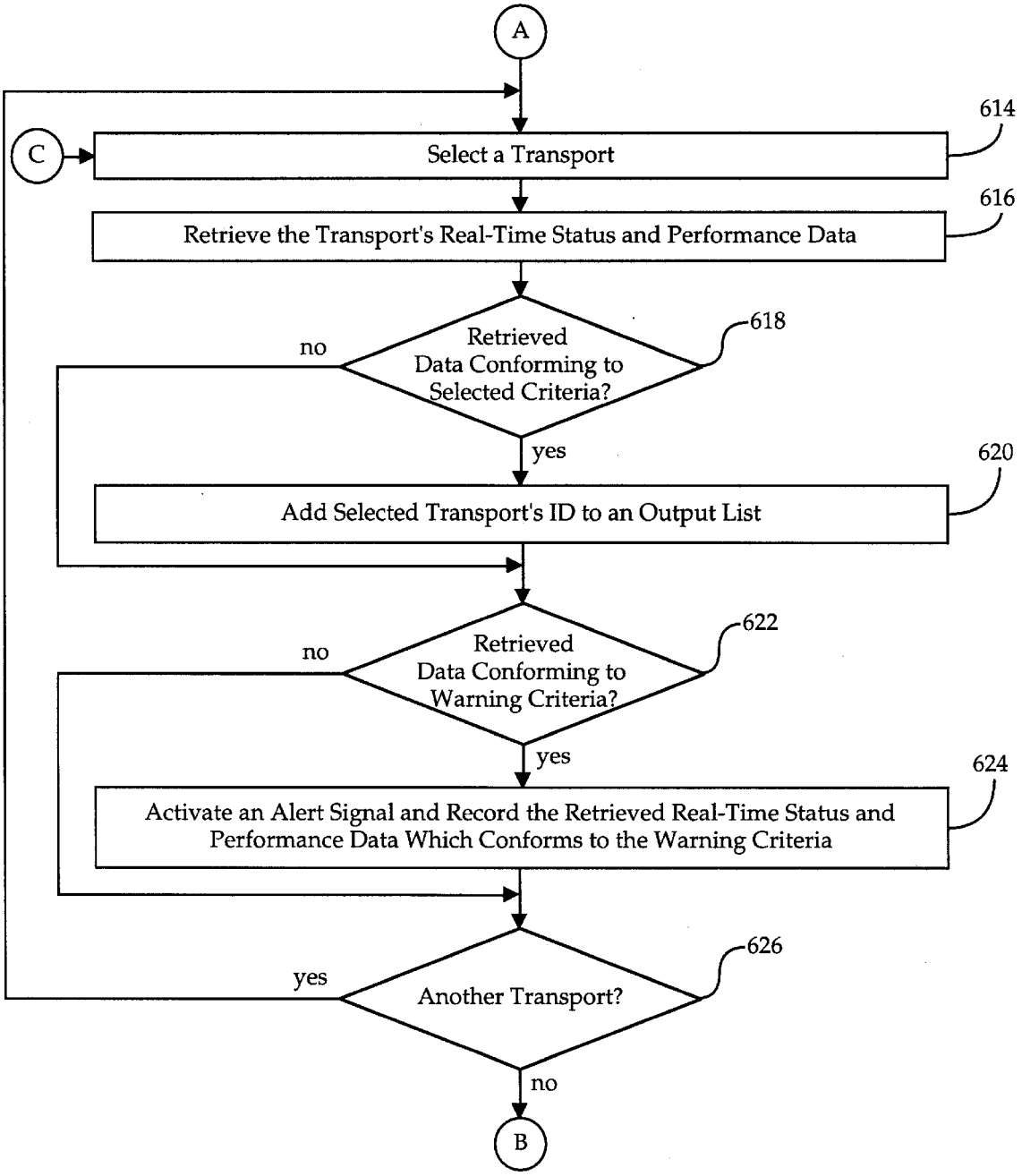

Referring now to FIG. 9*b*, in step 614, the map object (400 through 412) or the report object (414 through 420) selects a transport, in the manner discussed above. In step 616, the map object (400 through 412) or report object (414 through 420) retrieves the transport's real-time status and performance data, as kept updated by the transport's respective transport object (70 through 89), in the manner discussed above. In step 618, the map object (400 through 412) or report object (414 through 420) compares the data retrieved in step 616 with the selected criteria specified in either step 606 or step 610, in the manner discussed above. In step 620, if the answer in step 618 is yes, the map object (400 through 412) or report object (414 through 420) adds the selected transport's identification (ID) to an output list. Else, if the answer in step 618 is no, the method proceeds to step 622, where the map object (400 through 412) or report object (414 through 420) determines whether the data retrieved in step 616 conforms with the warning criteria specified in step 612. In step 624, if the answer in step 622 is yes, the map object (400 through 412) or report object (414 through 420) activates an alert signal, preferably comprising both a visual and an audible warning on the output device 52, as is described above, and records the retrieved real-time status and performance data which conforms to the warning criteria in the storage device 56 for later retrieval. Else, if the answer in step 622 is no, the method proceeds to step 626, where the map object (400 through 412) or the report object (414 through 420) determines whether another transport that the map object (400 through 412) or the report object (414 through 420) is responsible for monitoring that has not undergone steps 614 through 624 exists. If the answer in step 626 is yes, the preferred method returns to step 614, else the method proceeds to step 628 in FIG. 9*c*.

Figure 9C:
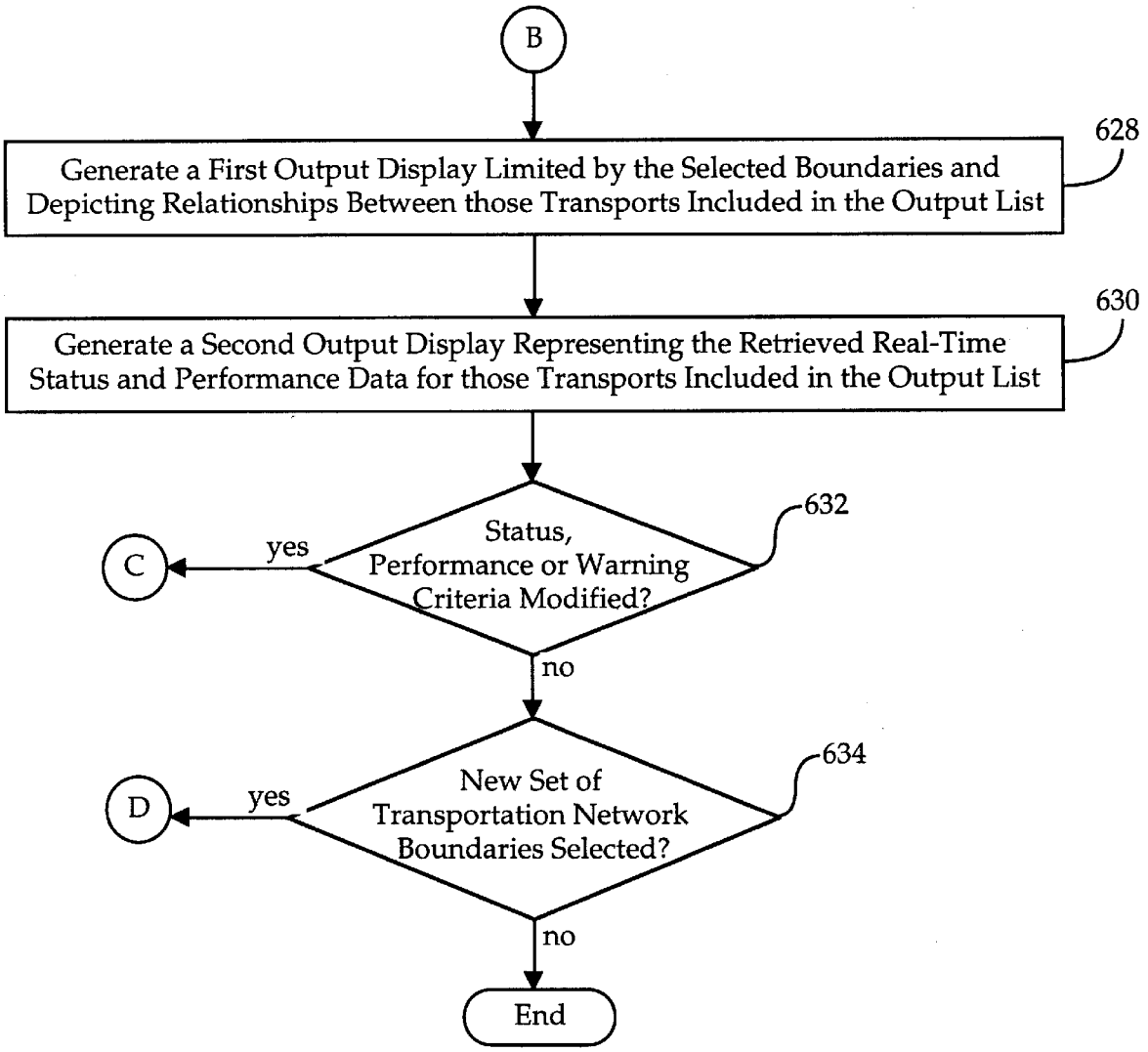

Referring now to FIG. 9*c*, the preferred method continues with step 628 where the map object (400 through 412) or the report object (414 through 420) generates a first output display limited by the selected boundaries and depicting relationships between those transports included in the output list, as described above. In step 630, the map object (400 through 412) or the report object (414 through 420) generates a second output display representing the retrieved real-time status and performance data for those transports included in the output list, as was described above. In step 632, the map object (400 through 412) or the report object (414 through 420) determines whether the status, performance or warning criteria have been modified, as was described above. If the answer in step 632 is yes, the preferred method returns to step 614, else the preferred method proceeds to step 634. In 634, the map object (400 through 412) or the report object (414 through 420) determines whether a new set of transportation network 20 boundaries are selected. If the answer in step 634 is yes, the preferred method returns to step 600, else the preferred method ends.

While the present invention has been described with reference to certain preferred embodiments, those skilled in the art will recognize that various modifications may be provided by a person of ordinary skill so as to apply the present invention to air, land, sea, and space cargo transportation networks. Variations upon and modifications to the preferred embodiments are provided for by the present invention, which is limited only by the following claims.

What is claimed is:

1. A computer-implemented method for management of an object-based railroad transportation network, comprising the steps of:

collecting a set of real-time identification, position, interconnection and display characteristics for mobile transports and fixed transports within the transportation network; and generating a map characterizing relationships between the transports based on said characteristics;

wherein the step of collecting comprises the steps of detecting one of the mobile transports passing by a wayside occupancy detector and responsively generating a unique transport detector signal;

translating the unique transport detector signal into a mobile transport latitude/longitude coordinate; and accepting entry of a fixed transport latitude/longitude coordinate corresponding to the location of one of the fixed transports; and wherein the step of generating a map comprises the steps of positioning a mobile transport icon on one of the maps at the mobile transport latitude/longitude coordinate; and positioning a fixed transport icon on one of the maps at the fixed transport latitude/longitude coordinate.

2. The method of claim 1 wherein each of the positioning steps comprises placing a consist attribute proximate to the transport icon.

3. A computer-implemented method for management of an object-based railroad transportation network, comprising the steps of:

collecting a set of real-time identification, position, interconnection and display characteristics for mobile transports and fixed transports within the transportation network;

generating a map characterizing relationships between the transports based on said characteristics;

selecting transportation network boundaries; and determining a transportation network layout within the transportation network boundaries;

wherein the generating step uses the transportation network boundaries to limit the maps and the reports.

4. A computer-implemented system for management of an object-based railroad transportation network, comprising:

means for collecting a set of real-time identification, position, interconnection and display characteristics for mobile transports and fixed transports within the transportation network; and means for generating a map characterizing relationships between the transports based on said characteristics;

wherein the means for collecting comprises means for detecting one of the mobile transports passing by a wayside occupancy detector and responsively generating a unique transport detector signal;

means for translating the unique transport detector signal into a mobile transport latitude/longitude coordinate; and means for accepting entry of a fixed transport latitude/longitude coordinate corresponding to the location of one of the fixed transports; and wherein the means for generating a map comprises means for positioning a mobile transport icon on one of the maps at the mobile transport latitude/longitude coordinate; and means for positioning a fixed transport icon on one of the maps at the fixed transport latitude/longitude coordinate.

5. A computer-implemented system for management of an object-based railroad transportation network, comprising:

means for collecting a set of real-time identification, position, interconnection and display characteristics for mobile transports and fixed transports within the transportation network;

means for generating a map characterizing relationships between the transports based on said characteristics;

means for selecting transportation network boundaries; and means for determining a transportation network layout within the transportation network boundaries;

wherein the means for generating uses the transportation network boundaries to limit the maps and the reports.

6. A computer-useable medium having embodied therein computer-readable program code for causing a computer to manage an object-based railroad transportation network by performing steps comprising:

collecting a set of real-time identification, position, interconnection and display characteristics for mobile transports and fixed transports within the transportation network; and generating a map characterizing relationships between the transports based on said characteristics;

wherein the program code for performing the step of collecting comprises program code for performing the steps of:

detecting one of the mobile transports passing by a wayside occupancy detector and responsively generating a unique transport detector signal;

translating the unique transport detector signal into a mobile transport latitude/longitude coordinate; and accepting entry of a fixed transport latitude/longitude coordinate corresponding to the location of one of the fixed transports; and wherein the step of generating a map comprises the steps of positioning a mobile transport icon on one of the maps at the mobile transport latitude/longitude coordinate; and positioning a fixed transport icon on one of the maps at the fixed transport latitude/longitude coordinate.

7. A computer-useable medium having embodied therein computer-readable program code for causing a computer to manage an object-based railroad transportation network by performing steps comprising:

collecting a set of real-time identification, position, interconnection and display characteristics for mobile transports and fixed transports within the transportation network;

generating a map characterizing relationships between the transports based on said characteristics;

selecting transportation network boundaries; and determining a transportation network layout within the transportation network boundaries;

wherein the generating step uses the transportation network boundaries to limit the map.

8. A computer-implemented system for managing a transportation network, comprising:

detectors for generating detector signals in response to a presence of transports;

a memory coupled to the detectors and containing transport objects including program instructions for generating transport object data in response to the detector signals; and service objects including program instructions for graphically organizing and reporting on the transport object data;

a processor coupled to the memory and to the detectors, for executing program instructions contained in the memory;

wherein the detectors comprise wayside occupancy detectors geographically distributed throughout the transportation network, each generating a unique transport detector signal;

a database, containing transportation network operational data, coupled to the processor; wherein the transports include mobile transports having variable geographic locations and fixed transports having non-variable geographic locations;

wherein one of the transport objects assigns a first sub-set of the operational data and the unique transport detector signal to one of the mobile transports; and assigns a second sub-set of the operational data to one of the fixed transports; and wherein one of the service objects generates transport location maps, transport status statistics, and transport performance statistics; and field location computers, for storing in the operational data of the database one from a group consisting of incident reports, local jobs and yard jobs.

9. A computer-implemented system for managing a transportation network, comprising:

detectors for generating detector signals in response to a presence of transports;

a memory coupled to the detectors and containing transport objects including program instructions for generating transport object data in response to the detector signals; and service objects including program instructions for graphically organizing and reporting on the transport object data;

a processor coupled to the memory and to the detectors, for executing program instructions contained in the memory;

wherein the detectors comprise wayside occupancy detectors geographically distributed throughout the transportation network, each generating a unique transport detector signal;

a database, containing transportation network operational data, coupled to the processor; wherein the transports include mobile transports having variable geographic locations and fixed transports having non-variable geographic locations;

wherein one of the transport objects assigns a first sub-set of the operational data and the unique transport detector signal to one of the mobile transports; and assigns a second sub-set of the operational data to one of the fixed transports; and wherein one of the service objects generates transport location maps, transport status statistics, and transport performance statistics; and a customer service center computer, for storing in the operational data of the database one from a group consisting of work orders and transport alert criteria.

10. A computer-implemented system for managing a transportation network, comprising:

detectors for generating detector signals in response to a presence of transports;

a memory coupled to the detectors and containing transport objects including program instructions for generating transport object data in response to the detector signals; and service objects including program instructions for graphically organizing and reporting on the transport object data;

a processor coupled to the memory and to the detectors, for executing program instructions contained in the memory;

wherein the detectors comprise wayside occupancy detectors geographically distributed throughout the transportation network, each generating a unique transport detector signal;

a database, containing transportation network operational data, coupled to the processor; wherein the transports include mobile transports having variable geographic locations and fixed transports having non-variable geographic locations;

wherein one of the transport objects assigns a first sub-set of the operational data and the unique transport detector signal to one of the mobile transports; and assigns a second sub-set of the operational data to one of the fixed transports; and wherein one of the service objects generates transport location maps, transport status statistics, and transport performance statistics; and an operations center computer, for storing in the operational data of the database one from a group consisting of equipment inventories, slow orders, curfews, power assignments, power plan, train plan and physical plant data.

11. A computer-implemented method for object based management of a railroad transportation network including transports, comprising the steps of:

defining boundary criteria for one of the transports;

acquiring real-time status and performance data for the one of the transports;

generating a report representing a real-time status and performance of the one of the transports when the acquired real-time status and performance data conforms to the defined boundary criteria;

generating a map, representing the real-time status and performance of the one of the transports when the acquired real-time status and performance data conforms to the defined boundary criteria;

defining warning criteria for one of the transports; and activating an alert signal if the acquired real-time status and performance data conforms to the warning criteria of the one of the transports;

wherein the step of defining warning criteria comprises the steps of:

selecting, from an attributes data field, a data item describing one of the transports;

specifying expected values for the data item; and defining the warning criteria for the one of the transports to be when the acquired real-time status and performance data for the one of the transports is outside the specified expected values.

12. A computer-implemented method for object based management of a railroad transportation network including transports, comprising the steps of:

defining boundary criteria for one of the transports;

acquiring real-time status and performance data for the one of the transports;

generating a report representing a real-time status and performance of the one of the transports when the acquired real-time status and performance data conforms to the defined boundary criteria; and generating a map, representing the real-time status and performance of the one of the transports when the acquired real-time status and performance data conforms to the defined boundary criteria;

wherein the transports include mobile transports and fixed transports and wherein the step of acquiring comprises retrieving, from a computer-aided dispatching system computer, a latitude and a longitude data item representing a location of one of the mobile transports.

13. A computer-implemented method for object based management of a railroad transportation network including transports, comprising the steps of:

defining boundary criteria for one of the transports;

acquiring real-time status and performance data for the one of the transports;

generating a report representing a real-time status and performance of the one of the transports when the acquired real-time status and performance data conforms to the defined boundary criteria; and generating a map, representing the real-time status and performance of the one of the transports when the acquired real-time status and performance data conforms to the defined boundary criteria;

wherein the transports include mobile transports and fixed transports and wherein the step of acquiring comprises retrieving, from field location computers, a latitude and a longitude data item representing the location of one of the fixed transports.

14. A computer-implemented method for object based management of a railroad transportation network including transports, comprising the steps of:

defining boundary criteria for one of the transports;

acquiring real-time status and performance data for the one of the transports;

generating a report representing a real-time status and performance of the one of the transports when the acquired real-time status and performance data conforms to the defined boundary criteria; and generating a map, representing the real-time status and performance of the one of the transports when the acquired real-time status and performance data conforms to the defined boundary criteria;

wherein the transports include mobile transports and fixed transports and wherein the step of acquiring comprises retrieving, from the field location computers, an incident report, a local job and a yard job data item.

15. A computer-implemented method for object based management of a railroad transportation network including transports, comprising the steps of:

defining boundary criteria for one of the transports;

acquiring real-time status and performance data for the one of the transports;

generating a report representing a real-time status and performance of the one of the transports when the acquired real-time status and performance data conforms to the defined boundary criteria; and generating a map, representing the real-time status and performance of the one of the transports when the acquired real-time status and performance data conforms to the defined boundary criteria;

wherein the transports include mobile transports and fixed transports and wherein the step of acquiring comprises retrieving, from a customer service center computer, a work order and a defined alert data item.

16. A computer-implemented method for object based management of a railroad transportation network including transports, comprising the steps of:

defining boundary criteria for one of the transports;

acquiring real-time status and performance data for the one of the transports;

generating a report representing a real-time status and performance of the one of the transports when the acquired real-time status and performance data conforms to the defined boundary criteria; and generating a map, representing the real-time status and performance of the one of the transports when the acquired real-time status and performance data conforms to the defined boundary criteria;

wherein the transports include mobile transports and fixed transports and wherein the step of acquiring comprises retrieving, from an operations center computer, an equipment inventory, a slow order, a curfew, a power assignment, a power plan, a train plan and a physical plant data item.

17. A computer-implemented method for object based management of a railroad transportation network including transports, comprising the steps of:

defining boundary criteria for one of the transports;

acquiring real-time status and performance data for the one of the transports;

generating a report representing a real-time status and performance of the one of the transports when the acquired real-time status and performance data conforms to the defined boundary criteria; and generating a map, representing the real-time status and performance of the one of the transports when the acquired real-time status and performance data conforms to the defined boundary criteria;

wherein the step of acquiring comprises: one step from a group consisting of retrieving, from a computer-aided dispatching system computer, a latitude and a longitude data item representing a location of a mobile transport;

retrieving, from a set of field location computers, a latitude and a longitude data item representing the location of a fixed transport;

retrieving, from the set of field location computers, an incident report, a local job and a yard job data item;

retrieving, from a customer service center computer, a work order and a defined alert data item; and retrieving, from an operations center computer, an equipment inventory, a slow order, a curfew, a power assignment, a power plan, a train plan and a physical plant data item; and wherein the step of generating comprises using the data items retrieved from the computer-aided dispatching system, the set of field locations, the customer service center and the operations center computers to generate one from the group consisting of the report and the map.

18. A computer-implemented system for managing a transportation network including transports, comprising:

means for defining boundary criteria for one of the transports;

means for acquiring real-time status and performance data for the one of the transports;

means for generating a report representing a real-time status and performance of the one of the transports when the acquired real-time status and performance data conforms to the defined boundary criteria;

means for generating a map, representing the real-time status and performance of the one of the transports when the acquired real-time status and performance data conforms to the defined boundary criteria;

means for defining warning criteria for one of the transports; and means for activating an alert signal if the acquired real-time status and performance data conforms to the warning criteria of the one of the transports;

wherein the means for defining warning criteria comprises:

means for selecting, from an attributes data field, a data item describing one of the transports;

means for specifying expected values for the data item; and means for defining the warning criteria for the one of the transports to be when the acquired real-time status and performance data for the one of the transports is outside the specified expected values.

19. A computer-useable medium having embodied therein computer-readable program code for causing a computer to manage an object-based railroad transportation network including transports by performing steps comprising:

defining boundary criteria for one of the transports;

acquiring real-time status and performance data for the one of the transports;

generating a report representing a real-time status and performance of the one of the transports when the acquired real-time status and performance data conforms to the defined boundary criteria;

generating a map, representing the real-time status and performance of the one of the transports when the acquired real-time status and performance data conforms to the defined boundary criteria;

defining warning criteria for one of the transports; and activating an alert signal if the acquired real-time status and performance data conforms to the warning criteria of the one of the transports;

wherein the step of defining warning criteria comprises the steps of:

selecting, from an attributes data field, a data item describing one of the transports;

specifying expected values for the data item; and defining the warning criteria for the one of the transports to be when the acquired real-time status and performance data for the one of the transports is outside the specified expected values.

* * * * *